US010449770B2

(12) United States Patent
Kawakami et al.

(10) Patent No.: US 10,449,770 B2
(45) Date of Patent: Oct. 22, 2019

(54) LIQUID DROPLET EJECTING APPARATUS, REMOTE MONITORING SYSTEM, AND METHOD OF DETERMINING REPLACEMENT NECESSITY OF LIQUID DROPLET EJECTING HEAD

(71) Applicant: SEIKO EPSON CORPORATION, Tokyo (JP)

(72) Inventors: Takayuki Kawakami, Matsumoto (JP); Shinsuke Yokote, Shiojiri (JP); Toshihiro Shinbara, Matsumoto (JP); Tsuyoshi Hayashi, Shiojiri (JP); Takeshi Yoshida, Shiojiri (JP); Yuji Kanazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/910,829

(22) Filed: Mar. 2, 2018

(65) Prior Publication Data

US 2018/0250938 A1 Sep. 6, 2018

(30) Foreign Application Priority Data

Mar. 3, 2017 (JP) ..... 2017-040117

(51) Int. Cl.

*B41J 2/045* (2006.01)
*B41J 2/165* (2006.01)
*B41J 2/14* (2006.01)

(52) U.S. Cl.

CPC ..... *B41J 2/16579* (2013.01); *B41J 2/0451* (2013.01); *B41J 2/04578* (2013.01); (Continued)

(58) Field of Classification Search

CPC ..... B41J 2/16579; B41J 2/16517; B41J 2/16508; B41J 2/1433; B41J 2/04578; (Continued)

(56) References Cited

U.S. PATENT DOCUMENTS 6,565,179 B1 5/2003 Bruch
2003/0142161 A1 7/2003 Miura et al.
(Continued)

FOREIGN PATENT DOCUMENTS

JP 04-074703 B 11/1992
JP 11-179884 A 7/1999
(Continued)

OTHER PUBLICATIONS

European Search Report issued in Application No. 18159325.2 dated Jul. 9, 2018.

*Primary Examiner* — Sharon A. Polk
(74) *Attorney, Agent, or Firm* — Workman Nydegger

(57) ABSTRACT

A liquid droplet ejecting apparatus includes a liquid droplet ejecting head that includes a plurality of nozzles from which a liquid supplied from a liquid supply source through a liquid supply path is ejected as a liquid droplet, and ejects the liquid droplet from the nozzle to a recording medium to perform a recording process, a first detecting section that detects a vibration waveform of the pressure chamber, which is vibrated when an actuator is driven to cause the pressure chamber communicating with the nozzle to vibrate, to detect a state inside the pressure chamber, and a second detecting section that reads a pattern formed on the recording medium by ejecting the liquid droplet from the nozzle to detect an ejection state of the liquid droplet.

12 Claims, 18 Drawing Sheets

(52) U.S. Cl.
CPC ..... *B41J 2/1433* (2013.01); *B41J 2/14314* (2013.01); *B41J 2/16508* (2013.01); *B41J 2/16517* (2013.01); *B41J 2002/14354* (2013.01); *B41P 2235/10* (2013.01); *B41P 2235/27* (2013.01)

(58) Field of Classification Search
CPC ..... B41J 2/0451; B41J 2/14314; B41J 2002/14354; B41P 2235/10; B41P 2235/27
See application file for complete search history.

(56) References Cited

U.S. PATENT DOCUMENTS

| | | | |
|---|---|---|---|
| 2004/0223027 | A1 | 11/2004 | Shinkawa et al. |
| 2010/0165022 | A1 | 7/2010 | Makuta et al. |
| 2013/0141484 | A1 | 6/2013 | Kasai et al. |
| 2013/0257945 | A1 | 10/2013 | Shinkawa et al. |
| 2013/0293610 | A1* | 11/2013 | Suzuki ..... B41J 2/04541 347/10 |
| 2016/0039203 | A1 | 2/2016 | Kamiyanagi et al. |
| 2016/0167364 | A1 | 6/2016 | Matsumoto et al. |

FOREIGN PATENT DOCUMENTS

| | | | |
|---|---|---|---|
| JP | 2000-238274 | A | 9/2000 |
| JP | 2007-021910 | A | 2/2007 |
| JP | 2009-178892 | A | 8/2009 |
| JP | 2009-202337 | A | 9/2009 |
| JP | 2009-269291 | A | 11/2009 |
| JP | 2009-269291 | A | 11/2009 |
| JP | 2010-155384 | A | 7/2010 |
| JP | 2013-111794 | A | 6/2013 |
| JP | 2013-248860 | A | 12/2013 |
| JP | 2014-084449 | A | 5/2014 |
| JP | 2016-112713 | A | 6/2016 |

* cited by examiner

EXPERIMENTAL VALUE AND CALCULATED VALUE OF RESIDUAL VIBRATION (NORMAL)

EXPERIMENTAL VALUE AND CALCULATED VALUE OF RESIDUAL VIBRATION (BUBBLE)

LIQUID DROPLET EJECTING APPARATUS, REMOTE MONITORING SYSTEM, AND METHOD OF DETERMINING REPLACEMENT NECESSITY OF LIQUID DROPLET EJECTING HEAD

BACKGROUND

1. Technical Field

The present invention relates to a liquid droplet ejecting apparatus, a remote monitoring system, and a method of determining a replacement necessity of a liquid droplet ejecting head.

2. Related Art

Currently, there is proposed an ink jet-type printer (liquid droplet ejecting apparatus) that performs printing by supplying ink (liquid) contained in a liquid supply source to a liquid droplet ejecting head through a liquid supply path and discharging the ink to a recording medium from a nozzle of the liquid droplet ejecting head, and the printer becomes practically used. In such a printer, since ink may not be satisfactorily discharged from a nozzle due to an influence such as bubbles in ink or thickened ink (that is, the nozzle is clogged), a cleaning mechanism which sucks the inside of the head through the nozzle is provided.

However, for example, when thickening of ink progresses and the ink is solidified, clogging of the nozzle (discharging failure) may not be sufficiently recovered in cleaning being performed by the cleaning mechanism. Also, even when the same cleaning is repeatedly performed on such a nozzle in which the clogging is hardly recovered, it is difficult to recover the clogging, and the ink is only uselessly consumed.

Here, in recent years, there is proposed a liquid droplet ejecting head which is provided with a piezoelectric element that changes a capacity of a liquid chamber storing ink, and an inspection unit that inspects a discharging state of the ink from each nozzle by acquiring information relating to residual vibration of the liquid chamber detected by the piezoelectric element while a driving signal for causing the capacity of the liquid chamber to be changed within a range in which the liquid is not discharged to the piezoelectric element from the nozzle is output (for example, see JP-A-2014-94449). When such a configuration is employed, whether or not discharging of the nozzle is failed can be inspected without discharging the ink from the nozzle, and it is possible to reduce an amount of the ink to be consumed.

However, even when a technique disclosed in JP-A-2014-94449 is employed, it is not possible to check whether or not ink discharged from the nozzle is accurately attached (landed) onto the recording medium in actual. Therefore, the ejection state of a liquid droplet from the nozzle cannot be accurately determined, and there is a possibility that a replacement necessity of the liquid droplet ejecting head cannot be accurately determined. Also, such a problem is not limited to a printer which ejects ink, and is generally common to a liquid droplet ejecting apparatus which discharges liquid droplets.

SUMMARY

An advantage of some aspects of the invention is to provide a liquid droplet ejecting apparatus capable of maintaining an ejection state of a liquid droplet from a nozzle.

According to an aspect of the invention, there is provided a liquid droplet ejecting apparatus including a liquid droplet ejecting head that includes a plurality of nozzles from which a liquid supplied from a liquid supply source through a liquid supply path is ejected as a liquid droplet, and ejects the liquid droplet from the nozzle to a recording medium to perform a recording process, a first detecting section that detects a vibration waveform of the pressure chamber, which is vibrated when an actuator is driven to cause the pressure chamber communicating with the nozzle to vibrate, and detects a state inside the pressure chamber, and a second detecting section that reads a pattern formed on the recording medium by ejecting the liquid droplet from the nozzle and detects an ejection state of the liquid droplet.

According to the invention, the liquid droplet ejecting apparatus capable of maintaining the ejection state of the liquid droplet from the nozzle can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid droplet ejecting apparatus will be described with reference to drawings. The liquid droplet ejecting apparatus according to the embodiment is, for example, an ink jet type printer that performs printing by ejecting ink, which is an example of liquid, onto a recording medium such as a recording sheet.

First Embodiment

Figure 1:
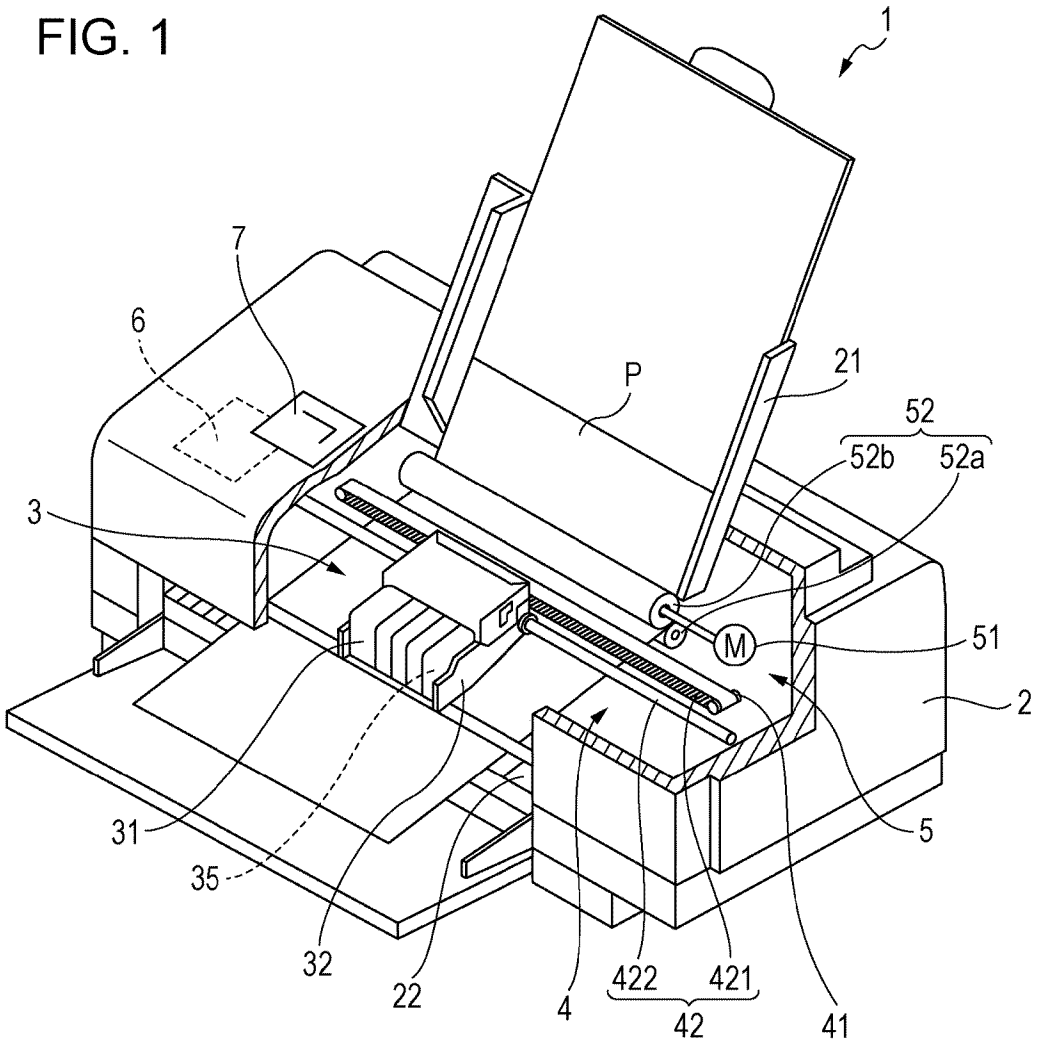
FIG. 1 is a diagram schematically illustrating a configuration of a printer according to a first embodiment of the invention.

FIG. 1 is a diagram schematically illustrating a configuration of an ink jet printer 1 (hereinafter, simply referred to as a "printer") as a liquid droplet ejecting apparatus in a first embodiment. Also, in the description below, in FIG. 1, an upper side in a vertical direction is referred to as an "upper portion", and a lower side in the vertical direction is referred to as a "lower portion". Firstly, a mechanical configuration of the printer 1 is described.

The printer 1 illustrated in FIG. 1 is provided with an apparatus main body 2, and a tray 21 to which a recording sheet P is installed is provided in the backward upper portion, a paper discharging opening 22 that discharges the recording sheet P is provided in the forward lower portion, and an operation panel 7 is provided on the upper surface.

The operation panel 7 is configured with, for example, a liquid crystal display, an organic EL display, and an LED lamp, and includes a display portion (not illustrated) that displays an error message or the like, and an operation portion (not illustrated) configured with various kinds of switches.

In addition, inside the apparatus main body 2, mainly, a printing apparatus 4 including a typing section 3 which reciprocates, a paper feeding apparatus 5 that feeds and discharges the recording sheet P to and from the printing apparatus 4, and a control portion 6 that controls the printing apparatus 4 and the paper feeding apparatus 5 are included.

The paper feeding apparatus 5 intermittently transmits the recording sheet P one by one under the control of the control portion 6. The recording sheet P passes through a portion near the lower portion of the typing section 3. At this point, the typing section 3 reciprocates in a direction substantially orthogonal to the direction of transmitting the recording sheet P, and performs printing on the recording sheet P. That is, the reciprocating of the typing section 3 and the intermittent transmission of the recording sheet P become main scanning and subscanning, to perform ink jet-type printing.

The printing apparatus 4 includes the typing section 3, a carriage motor 41 that becomes a driving source that causes the typing section 3 to move (to reciprocate) in the main scanning direction, and a reciprocating driving mechanism 42 that receives the rotation of the carriage motor 41, and causes the typing section 3 to reciprocate.

The typing section 3 includes a plurality of head units 35, an ink cartridge (I/C) 31 (liquid supply source) that supplies ink to the respective head units 35, and a carriage 32 to which the respective head units 35 and an ink cartridge 31 are mounted. Further, in the case of the ink jet printer that consumes a lot of the amount of ink, the ink cartridge 31 may not be mounted on the carriage 32, and instead may be installed in another location, and communicate with the head units 35 through a tube so that the ink is supplied (not illustrated). Such a configuration will be described in a second embodiment with reference to FIG. 21.

Further, full color printing becomes possible by using cartridges filled with four colors of ink of yellow, cyan, magenta, and black, as the ink cartridges 31. In this case, the head units 35 respectively corresponding to each color are provided in the typing section 3. Here, the four ink cartridges 31 corresponding to four colors of ink are illustrated in FIG. 1, but the typing section 3 may be configured so as to further include the ink cartridges 31 including ink of other colors such as light cyan, light magenta, dark yellow, and special colors.

The reciprocating driving mechanism 42 includes carriage guide shafts 422 supported by a frame (not illustrated) on both ends, and a timing belt 421 extending in parallel to the carriage guide shafts 422.

The carriage 32 is supported by the carriage guide shafts 422 of the reciprocating driving mechanism 42 in a reciprocating manner, and is fixed to a part of the timing belt 421. If the timing belt 421 is forwardly and backwardly driven through a pulley by an operation of the carriage motor 41, the typing section 3 moves in a reciprocating manner, by being guided by the carriage guide shafts 422. Also, at the time of the reciprocating, ink drops are appropriately ejected from respective ink jet heads 100 of the head units 35 according to the image data to be printed (printing data), and printing on the recording sheet P is performed.

The paper feeding apparatus 5 includes a paper feeding motor 51 that becomes a driving source thereof, and paper feeding rollers 52 that rotate by the operation of the paper feeding motor 51. The paper feeding rollers 52 are configured with a driven roller 52*a* and a driving roller 52*b* that interpose a transportation route of the recording sheet P (the recording sheet P) and vertically face each other, and the driving roller 52*b* is connected to the paper feeding motor 51. Accordingly, the paper feeding rollers 52 transmit multiple sheets of recording sheet P installed in the tray 21 toward the printing apparatus 4 one by one, and discharge the multiple sheets of recording sheet P from the printing apparatus 4 one by one. Further, instead of the tray 21, a configuration in which a paper feeding cassette that accommodates the recording sheet P is mounted in a detachable manner is possible.

Moreover, the paper feeding motor 51 is interlocked with a reciprocating movement of the typing section 3, and transmits the recording sheet P according to a resolution of an image. A paper feeding movement and a paper transmitting movement may be performed by respective different motors, or may be performed by the same motor using a part that switches torque transmission such as an electromagnetic clutch.

The control portion 6 performs a printing process on the recording sheet P by controlling the printing apparatus 4, the paper feeding apparatus 5, and the like based on data to be printed, which is input from a host computer 8 such as a personal computer (PC) or a digital camera (DC). In addition, the control portion 6 causes respective portions to perform corresponding processes based on a depression signal which is input from an operation portion, and generated by pressing various kinds of switches, together with causing a display portion of the operation panel 7 to display an error message or the like, causing an LED lamp to be turned on/off, or the like. Moreover, the control portion 6 transmits information such as an error message or abnormal ejection to the host computer 8, if necessary.

Figure 2:
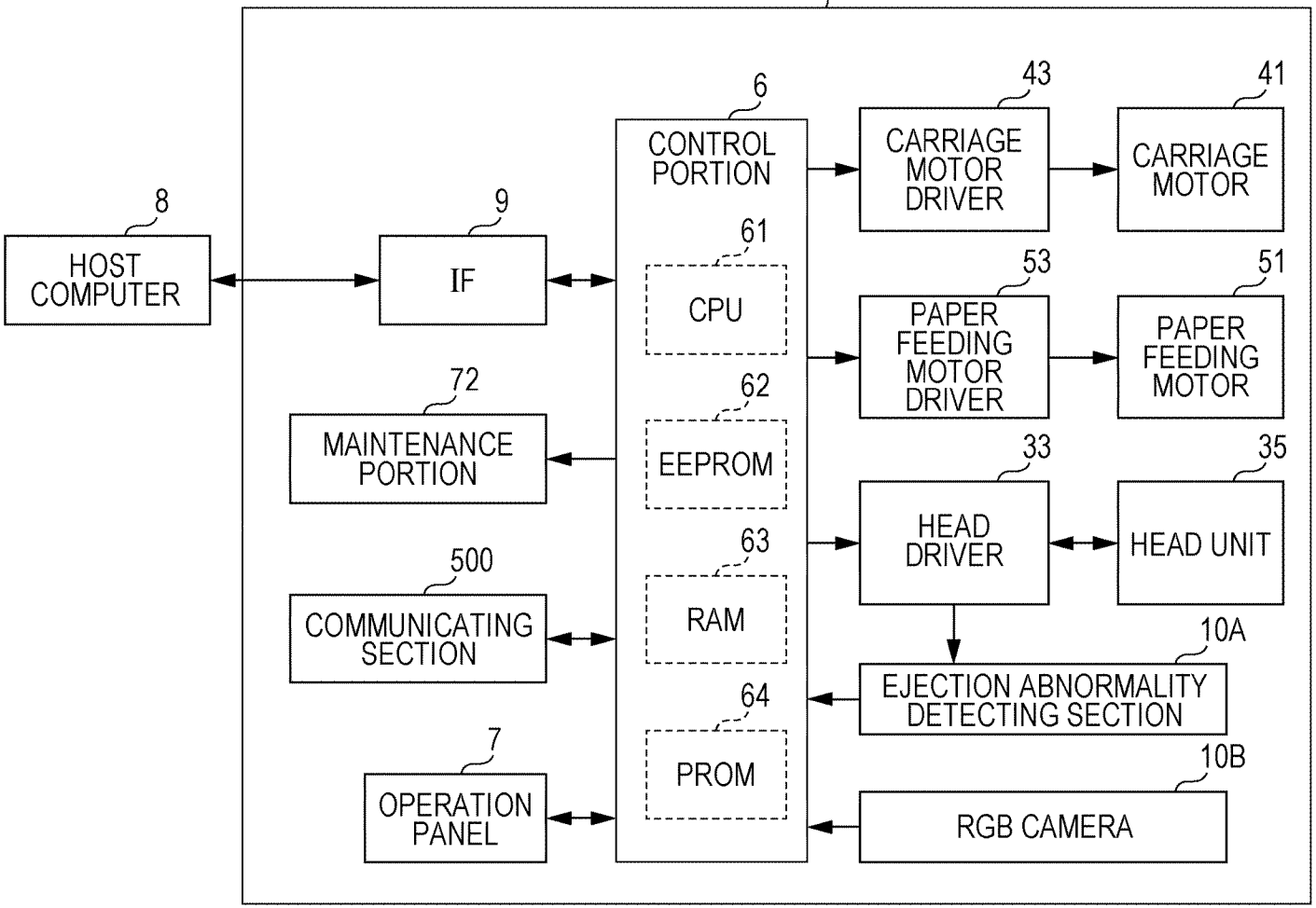
FIG. 2 is a block diagram schematically illustrating main portions of the printer.

Here, a functional configuration of the printer 1 according to the embodiment will be described with reference to FIG. 2. As illustrated in FIG. 2, the printer 1 includes an interface (IF) 9 that receives data relating to printing or the like which is input from the host computer 8, the control portion 6, the carriage motor 41, a carriage motor driver 43 that controls the driving of the carriage motor 41, the paper feeding motor 51, a paper feeding motor driver 53 that controls the driving of the paper feeding motor 51, the head units 35, a head driver 33 that controls the driving of the head units 35, an ejection abnormality detecting section 10A (the first detecting section), a RGB camera 10B (the second detecting section), an operation panel 7, a maintenance unit 72, and a communicating section 500. Also, the communicating section 500 will be described later with reference to FIG. 20.

In FIG. 2, the control portion 6 includes a central processing unit (CPU) 61 that performs various kinds of processes such as a printing process or an ejection abnormality detecting process, an electrically erasable programmable read-only memory (EEPROM) (storage section) 62 which is a kind of non-volatile semiconductor memory that stores the data to be printed which is input from the host computer 8 through the IF 9 in a data storage area (not illustrated), a random access memory (RAM) 63 that temporarily stores various kinds of data for performing the ejection abnormality detecting process described below, or temporarily stores an application program for the printing process or the like, and a PROM 64 that is a kind of non-volatile semiconductor memory that stores a control program that controls respective portions. Further, respective elements of the control portion 6 are electrically connected to each other through a bus (not illustrated).

As described above, the typing section 3 includes the plurality of head units 35 corresponding to respective colors of ink. In addition, the head units 35 each include a plurality of nozzles 110, and electrostatic actuators 120 respectively corresponding to the nozzles 110. That is, a head unit 35 is configured to include the plurality of ink jet heads 100 (liquid droplet ejecting heads) each of which has one set of the nozzles 110 and the electrostatic actuator 120. Also, the head driver 33 is configured with a driving circuit 18 that controls ejection timings of ink by driving the electrostatic actuators 120 of the respective ink jet heads 100, and switching sections 23 (see FIG. 12).

If the control portion 6 receives the data to be printed from the host computer 8 through the IF 9, the control portion 6 stores the data to be printed in the EEPROM 62. Also, the CPU 61 performs a predetermined process on the data to be printed, and outputs a driving signal to the respective drivers 33, 43, and 53 based on the processed data and the input data from the various kinds of sensors. If a driving signal is input through the respective drivers 33, 43, and 53, the plurality of electrostatic actuators 120 of the head units 35, the carriage motor 41 of the printing apparatus 4, and the paper feeding apparatus 5 are respectively operated. Accordingly, a printing process is performed on the recording sheet P.

In addition, the control portion 6 determines a replacement necessity of the ink jet head 100 based on the detected result from the ejection abnormality detecting section 10A and the RGB camera 10B (the detecting section). Specifically, after the maintenance unit 72 performs the maintenance operation, the control portion 6 determines that the ink jet head 100 is necessary to be replaced in a case in which either of whether or not the state inside the cavity 141 (to be described later) is not normal or whether or not the ejection state is not normal is detected by the detecting section predetermined number of times. That is, the control portion 6 functions as a determination section in the invention.

In addition, the control portion 6 checks whether or not the maintenance unit 72 functions normally, and then determines whether or not the ink jet head 100 is necessary to be replaced. The ejection abnormality detecting section 10A detects a vibration waveform of the cavity 141 before the maintenance operation, and detects the vibration waveform of the cavity 141 during the maintenance operation or after the maintenance operation. The control portion 6 determines that the maintenance unit 72 malfunctions in a case in which bubbles are determined to be increased inside the cavity 141 by the maintenance operation based on the vibration waveform detected by the ejection abnormality detecting section 10A.

In addition, in a case in which the ink jet head 100 (to be described later) is determined to be necessary to be replaced, the control portion 6 causes the display portion of the operation panel 7 to be display a gist thereof, and notifies the gist to an operator. That is, the operation panel 7 functions as a notification unit in the invention.

Figure 3:
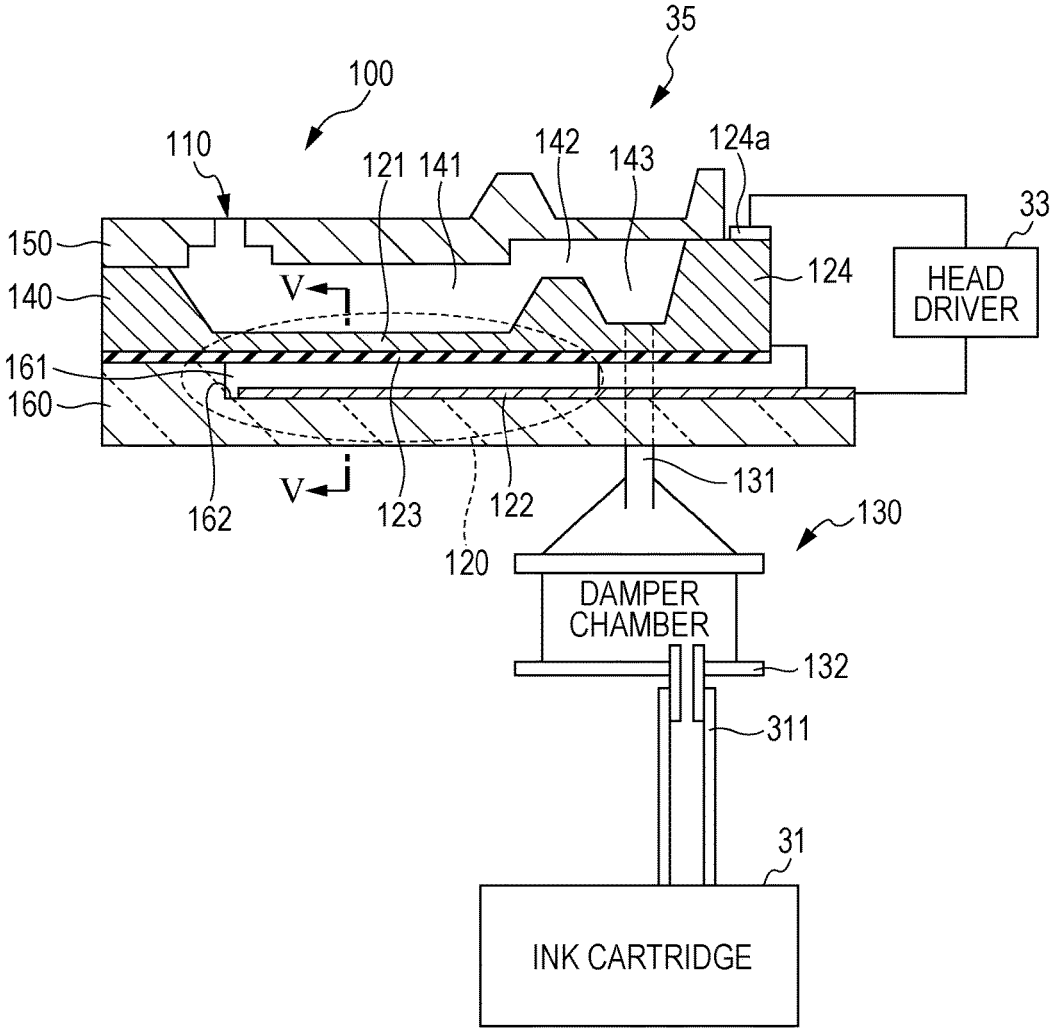
FIG. 3 is a cross-sectional view schematically illustrating a head unit (ink jet head) in the printer illustrated in FIG. 1.
Figure 4:
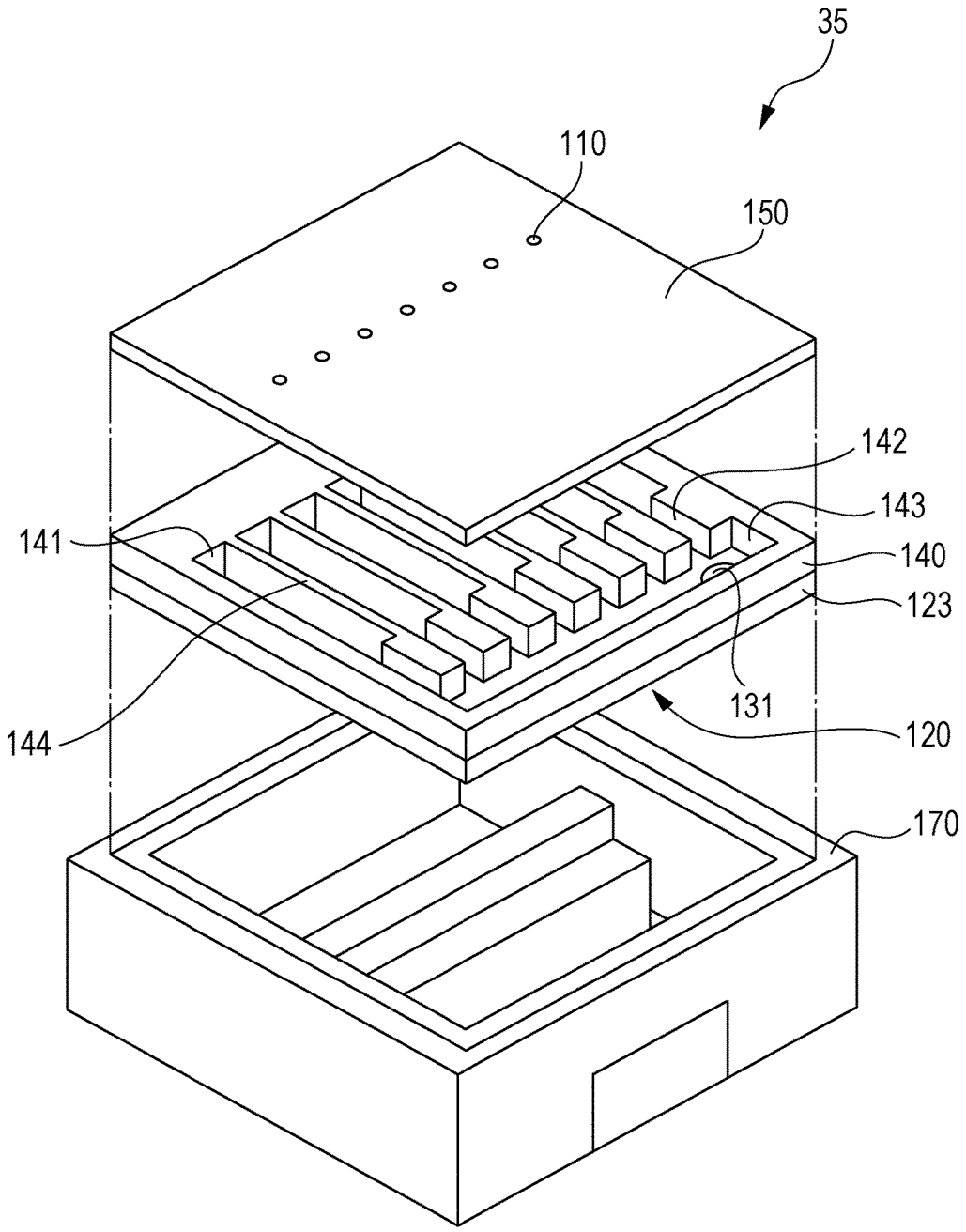
FIG. 4 is an exploded perspective view illustrating a configuration of the head unit illustrated in FIG. 3.

Next, configurations of the respective head units 35 in the typing section 3 are described. FIG. 3 is a cross-sectional view schematically illustrating the head unit 35 (the ink jet head 100) illustrated in FIG. 1, FIG. 4 is an exploded perspective view schematically illustrating a configuration of the head unit 35 corresponding to a color of ink. Further, FIGS. 3 and 4 are illustrated in a state of being turned upside down from the state of being generally used.

As illustrated in FIG. 3, the head unit 35 is connected to the ink cartridge 31 through an ink intake opening 131, a damper chamber 130, and an ink supplying tube 311. Here, the damper chamber 130 includes a damper 132 made of rubber. Since the damper chamber 130 is capable of absorbing the shaking of ink and the change of ink pressure caused when the carriage 32 reciprocates, and thus it is possible to stably supply a predetermined amount of the ink to the head unit 35.

In addition, the head unit 35 has a three-layer structure in which a silicon substrate 140 is interposed therebetween, a nozzle plate 150 made of silicon in the same manner is stacked on the upper side, and a glass substrate (glass substrate) 160 made of borosilicate having a similar coefficient of thermal expansion is stacked on the lower side. Grooves functioning as a plurality of independent cavities (pressure chamber) 141, one reservoir (common ink chamber) 143, and ink supplying openings (orifices) 142 that communicate the reservoir 143 with the cavities 141 are formed in the silicon substrate 140 in the center. For example, respective grooves can be formed by performing an etching process on the surface of the silicon substrate 140. The nozzle plate 150, the silicon substrate 140, and the glass substrate 160 are bonded in this sequence, and the respective cavities 141, the reservoir 143, the respective ink supplying openings 142 are partitioned and formed.

The cavities 141 are respectively formed in a strip shape (rectangular shape), the capacities thereof are changed according to vibrations (displacements) of vibration plates 121 described below, and the cavities 141 are configured so that ink (liquid material) is ejected from the nozzles 110 according to the changes of the capacities. In the nozzle plate 150, the nozzles 110 are formed at positions corresponding to portions on the distal end sides of the respective cavities 141, and these are communicated with the respective cavities 141. In addition, the ink intake opening 131 is formed that is communicated with the reservoir 143 in a portion of the glass substrate 160 in which the reservoir 143 is positioned. The ink is supplied from the ink cartridge 31 to the reservoir 143 through the ink supplying tube 311 (the liquid supply path), the damper chamber 130, and the ink intake opening 131. The ink supplied to the reservoir 143 is supplied to the respective independent cavities 141 through the respective ink supplying openings 142. Further, the respective cavities 141 are partitioned and formed by the nozzle plate 150, side walls (partitions) 144, and bottom walls 121.

With respect to the respective independent cavities 141, the bottom walls 121 thereof are formed with thin walls, the bottom walls 121 are configured to function as vibration plates (diaphragms) that can be elastically deformed (elastically displaced) in the off-plate direction (thickness direction), that is, in the vertical direction in FIG. 3. Accordingly, for convenience of explanation below, the portions of the bottom walls 121 are described by being called the vibration plates 121 (that is, hereinafter, both of the "bottom walls" and the "vibration plates" use the reference numeral 121).

Shallow concave portions 161 are formed at positions corresponding to the respective cavities 141 of the silicon substrate 140 on the surface on the silicon substrate 140 side of the glass substrate 160. Accordingly, the bottom walls 121 of the respective cavities 141 are opposed to surfaces of facing walls 162 of the glass substrate 160 on which the concave portions 161 are formed with the predetermined gaps interposed therebetween. That is, apertures having a predetermined thickness (for example, about 0.2 microns) exist between the bottom walls 121 of the cavities 141 and segment electrodes 122. Further, the concave portions 161 can be formed by, for example, etching.

Here, the respective bottom walls (vibration plates) 121 of the cavities 141 configure a portion of common electrodes 124 on the cavities 141 side respectively for accumulating electric charges by driving signals supplied from the head driver 33. That is, the respective vibration plates 121 of the cavities 141 also function as a portion of corresponding facing electrodes (facing electrodes of capacitor) of the electrostatic actuators 120. Also, the segment electrodes 122 that are electrodes respectively facing the common electrodes 124 are formed so as to oppose the respective bottom walls 121 of the cavities 141 on the surfaces of the concave portions 161 of the glass substrate 160. In addition, as illustrated in FIG. 3, the respective surfaces of the bottom walls 121 of the cavities 141 are covered with an insulation layer 123 made of a silicon oxide film (SiO2). In this manner, the respective bottom walls 121 of the cavities 141, that is, the vibration plates 121 and the respective segment electrodes 122 corresponding thereto form (configure) facing electrodes (facing electrodes of capacitor) with the insulation layer 123 formed on the surface on the lower side of the bottom walls 121 of the cavities 141 in FIG. 3 and apertures in the concave portions 161. Accordingly, main portions of the electrostatic actuators 120 are configured with the vibration plates 121, the segment electrodes 122, and the insulation layer 123 and the apertures interposed therebetween.

As illustrated in FIG. 3, the head driver 33 including the driving circuit 18 for applying a driving voltage between the facing electrodes charges and discharges electricity between the facing electrodes according to a typing signal (typing data) input from the control portion 6. An output terminal on one side of a head driver 33 is connected to the respective segment electrodes 122, and the other output terminal is connected to input terminals 124*a* of the common electrodes 124 formed on the silicon substrate 140. Further, impurities are injected into the silicon substrate 140, and the silicon substrate 140 itself has conductivity. Therefore, it is possible to supply a voltage from the input terminals 124*a* of the common electrodes 124 to the common electrodes 124 of the bottom walls 121. In addition, for example, a thin film made of a conductive material such as gold or copper may be formed on one surface of the silicon substrate 140. Accordingly, it is possible to supply a voltage (charge) to the common electrodes 124 with low electric resistance (effectively). The thin film may be formed by, for example, evaporation or sputtering. Here, according to the embodiment, since the silicon substrate 140 and the glass substrate 160 are joined (bonded), for example, by anode bonding, a conductive film used as an electrode in the anode joining is formed on a path forming surface side of the silicon substrate 140 (upper portion of the silicon substrate 140 illustrated in FIG. 3). Also, the conductive film is used as the input terminal 124*a* of the common electrode 124. Further, for example, the input terminal 124*a* of the common electrodes 124 may be omitted, and also the method of bonding the silicon substrate 140 and the glass substrate 160 is not limited to the anode joining.

As illustrated in FIG. 4, the head unit 35 includes the nozzle plate 150 in which the plurality of nozzles 110 are formed, the silicon substrate (ink chamber substrate) 140 in which the plurality of cavities 141, the plurality of ink supplying openings 142, and the one reservoir 143 are formed, and the insulation layer 123, and these are stored in a base body 170 including the glass substrate 160. The base body 170 is configured with, for example, various kinds of resin materials, and various kinds of metal materials, and the silicon substrate 140 is fixed to and supported by the base body 170.

Figure 5A:
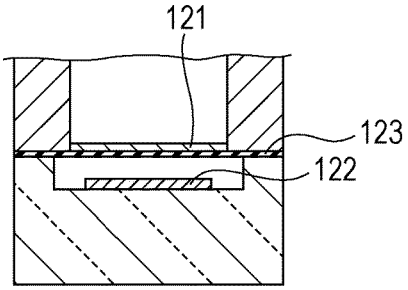
FIGS. 5A to 5C is diagrams illustrating respective states of the cross section taken along lines V-V in FIG. 3 when a driving signal is input.
Figure 5B:
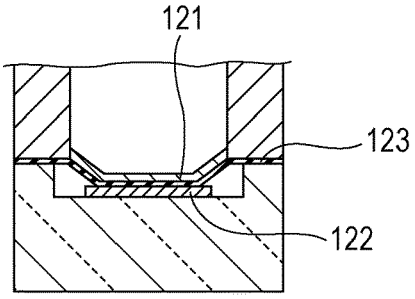
Figure 5C:
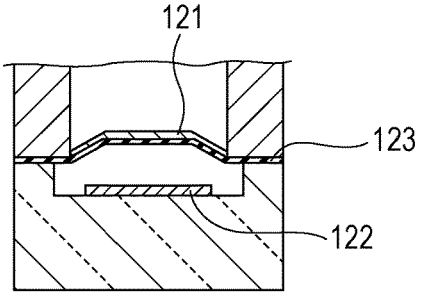

FIGS. 5A to 5C are diagrams illustrating respective states of the cross section taken along a line V-V in FIG. 3 when a driving signal is input. If the driving voltage is applied between facing electrodes from the head driver 33, Coulomb force is generated between the facing electrodes, and the bottom wall (vibration plate) 121 bends toward the segment electrode 122 side from the initial state (FIG. 5A) so that the capacity of the cavity 141 increases (FIG. 5B). In this state, under the control of the head driver 33, if charges between the facing electrode are suddenly discharged, the vibration plate 121 is restored upwardly in the drawing by the elastic restoration force, and moves to the upper portion passing a position of the vibration plate 121 in the initial state, so that the capacity of the cavity 141 rapidly shrinks (FIG. 5C). At this point, a portion of the ink (liquid material) that fills the cavity 141 is ejected from the nozzle 110 communicating with the cavity 141 as an ink drop by the compression pressure generated in the cavity 141.

The respective vibration plate 121 of the cavity 141 performs damped vibrations by a series of operations (an ink ejection operation by a driving signal of the head driver 33) until a next driving signal (driving voltage) is input, and a next ink drop is ejected. Hereinafter, the damped vibration is referred to as a residual vibration. It is assumed that the residual vibration of the vibration plate 121 has a natural vibration frequency determined by an acoustic resistance r determined by shapes of the nozzles 110 or the ink supplying openings 142, or a coefficient of viscosity of the ink, inertance m determined by a weight of the ink in the path, and a compliance Cm of the vibration plate 121.

Figure 6:
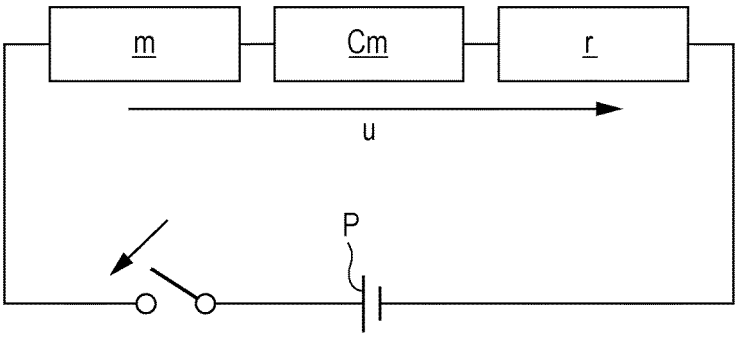
FIG. 6 is a circuit diagram illustrating a calculation model of a simple harmonic vibration assuming residual vibration of a vibration plate in FIG. 3.

A calculation model of the residual vibration of the vibration plate 121 based on the above assumption is described. FIG. 6 is a circuit diagram illustrating a calculation model of the simple harmonic vibration assuming the residual vibration of the vibration plate 121. In this manner, the calculation model of the residual vibration of the vibration plate 121 is expressed by an acoustic pressure P, the inertance m, the compliance Cm, and the acoustic resistance r which are described above. Also, if a step response with respect to a volume velocity u when the acoustic pressure P is applied to a circuit in FIG. 6 is calculated, the following expressions can be obtained.

$$u = \frac{P}{\omega \cdot m} e^{-\alpha t} \cdot \sin \omega t \tag{1}$$

$$\omega = \sqrt{\frac{1}{m \cdot C_m} - \alpha^2} \tag{2}$$

$$\alpha = \frac{\Gamma}{2m} \tag{3}$$

Figure 7:
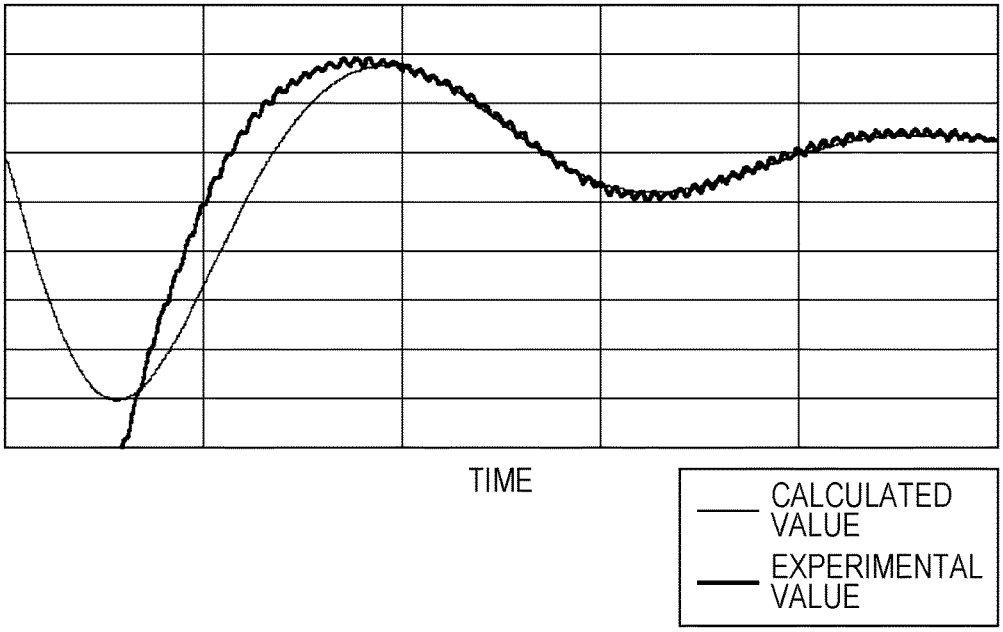
FIG. 7 is a graph illustrating a relationship between an experimental value and a calculated value of the residual vibration of the vibration plate of FIG. 3 in the case of a normal ejection.

The calculation results obtained from the expressions above and the experimental results in separately performed experiments of the residual vibrations of the vibration plate 121 after the ejection of ink drops are compared. FIG. 7 is a graph illustrating a relationship between the experimental value and the calculated value of the residual vibration of the vibration plate 121. As can be understood from the graph illustrated in FIG. 7, two waveforms of the experimental value and the calculated value are substantially identical to each other.

However, in the respective ink jet heads 100 of the head units 35, a phenomenon in which ink drops are not normally ejected from the nozzles 110 though the ejection operation described above is performed, that is, abnormal ejection of the liquid droplet may be generated. As a cause of the generation of the abnormal ejection, as described below, (1) the mixture of bubbles into the cavity 141, (2) the drying and the thickening (adherence) of the ink near the nozzle 110, (3) the attachment of the paper dust near the outlets of the nozzles 110, and the like are included.

When the abnormal ejection is generated, the liquid droplet typically is not ejected from the nozzles 110 as a result, that is, the non-ejection phenomenon of the liquid droplet is performed. In this case, dot omission of pixels in an image printed (drawn) on the recording sheet P occurs. In addition, if the abnormal ejection occurs, even if the liquid droplet is ejected from the nozzles 110, since an amount of the liquid droplet is too small, or the direction of flight (trajectory) of the liquid droplet is deviated, the liquid droplet does not impact on an appropriate portion. Therefore, dot omission in the image occurs. Accordingly, in the description below, the abnormal ejection of the liquid droplet may also be referred to as "dot omission".

Hereinafter, based on the comparison results illustrated in FIG. 7, values of the acoustic resistances r or the inertances m are adjusted according to causes of the dot omission (abnormal ejection) phenomenon (non-ejection phenomenon of liquid drop) in the printing processes that are generated in the nozzles 110 of the ink jet heads 100, so that the calculated values and the experimental values of the residual vibrations of the vibration plates 121 match with each other.

Figure 8:
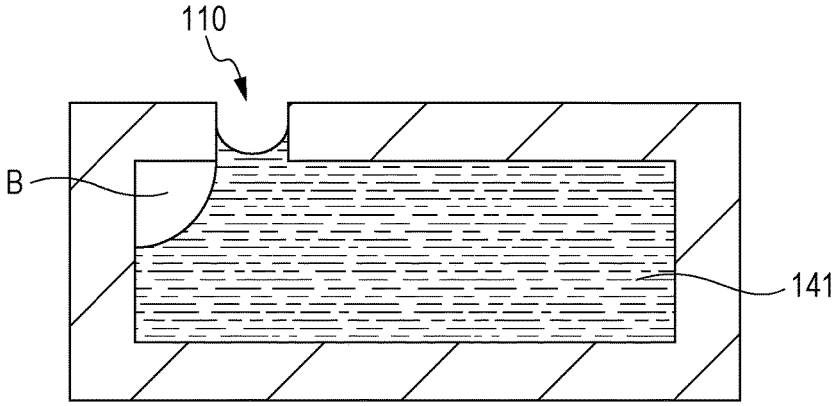
FIG. 8 is a conceptual diagram illustrating a portion near a nozzle when a bubble is mixed into a cavity in FIG. 3.

First, the mixture of the bubbles into the cavities 141 which is one of the causes of the dot omission is discussed. FIG. 8 is a conceptual diagram illustrating a portion near the nozzle 110 when a bubble B is mixed into the cavity 141 in FIG. 3. As illustrated in FIG. 8, it is assumed that the generated bubble B is generated and attached on a wall surface of the cavity 141 (as an example of the attachment position of the bubble B, FIG. 8 illustrates a case in which the bubble B is attached near the nozzle 110).

In this manner, it is considered that, if the bubble B is mixed into the cavity 141, the total weight of the ink that fills the cavity 141 is reduced, and the inertance m is decreased. In addition, since the bubble B is attached to the wall surface of the cavity 141, the state becomes as if the diameter of the nozzle 110 increases by a size of the diameter thereof, so that the acoustic resistance r is decreased.

Figure 9:
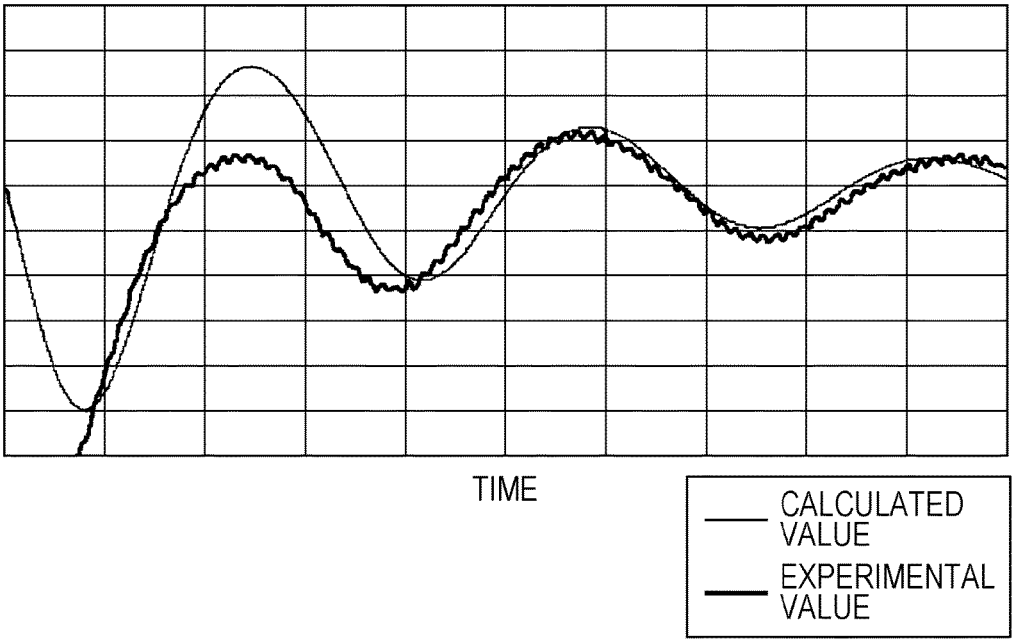
FIG. 9 is a graph illustrating a calculated value and an experimental value of the residual vibration when the ink drops cannot be ejected due to the bubble mixture into the cavity.

Accordingly, the acoustic resistance r and the inertance m match with the experimental values of the residual vibration when the bubble is mixed by setting the acoustic resistance r and the inertance m to be smaller than those in the case of FIG. 7 in which the ink is normally ejected so that the result (graph) as illustrated in FIG. 9 can be obtained. As can be understood from the graphs of FIGS. 7 and 9, when the bubble is mixed into the cavity 141, a characteristic residual vibration waveform in which a frequency becomes higher than in the normal ejection can be obtained. Further, a damping rate of amplitude of the residual vibration is decreased by the decrease of the acoustic resistance r or the like. Therefore, it is checked that the amplitude of the residual vibration is slowly decreased.

Figure 10:
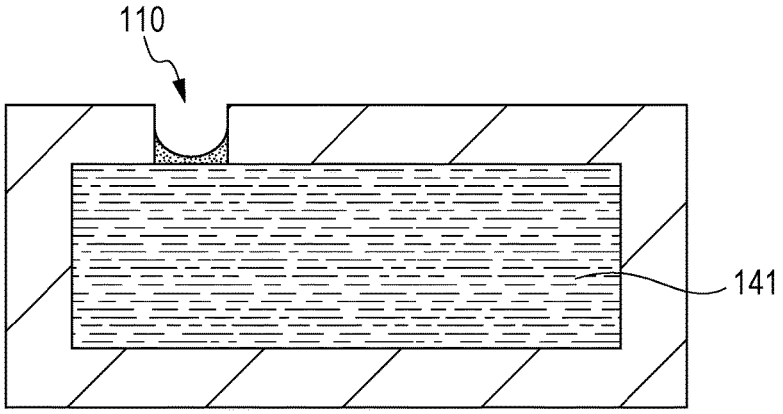
FIG. 10 is a conceptual diagram illustrating a portion near the nozzle when the ink is dried and adhered near the nozzle in FIG. 3.

Next, the drying (adherence or thickening) of the ink near the nozzle 110 which is another reason for the dot omission is discussed. FIG. 10 is a conceptual diagram illustrating a portion near the nozzle 110 when the ink is dried and adhered near the nozzle 110 in FIG. 3. As illustrated in FIG. 10, when the ink near the nozzle 110 is dried and adhered, the state becomes as if the ink in the cavity 141 is trapped in the cavity 141. In this manner, if the ink near the nozzle 110 is dried and thickened, it is considered that the acoustic resistance r increases.

Figure 11:
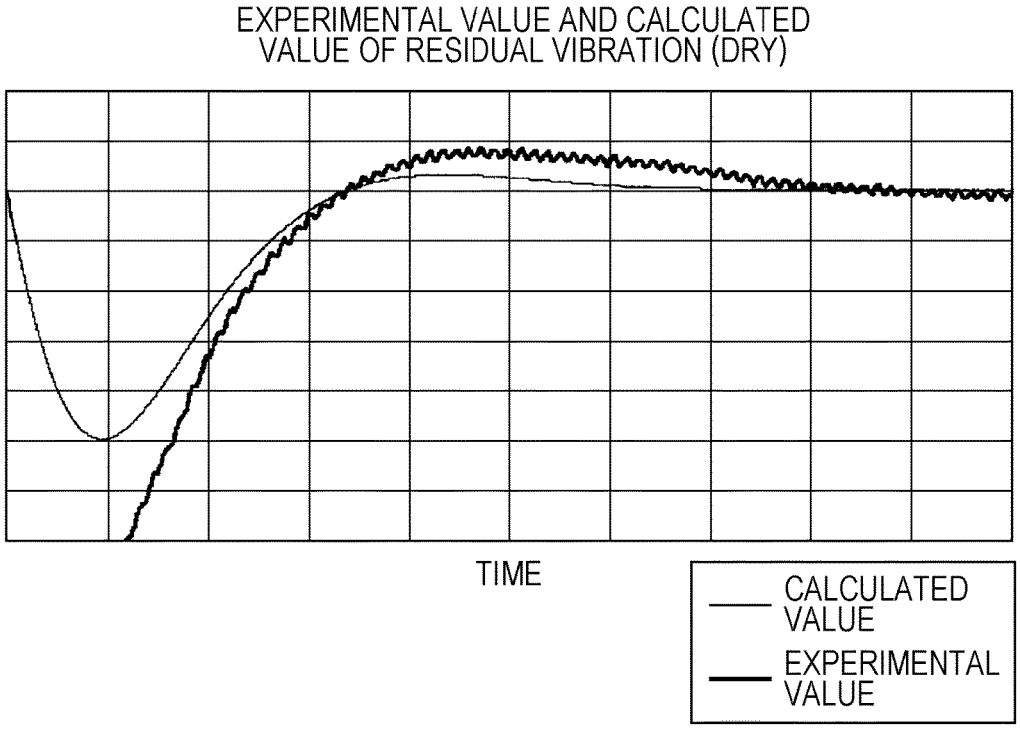
FIG. 11 is a graph illustrating a calculated value and an experimental value of the residual vibration when the ink is dried and thickened near the nozzle.

Accordingly, the acoustic resistance r matches with the experimental values of the residual vibration when the ink is dried, and adhered (thickened) near the nozzle 110 by setting the acoustic resistance r to be greater than that in the case of FIG. 7 in which the ink is normally ejected so that the result (graph) as illustrated in FIG. 11 can be obtained. Further, the experimental value expressed in FIG. 11 is obtained by measuring the residual vibration of the vibration plate 121 in a state in which the head unit 35 without mounting a cap (not illustrated) is left for several days, and the ink near the nozzle 110 is dried and thickened so that the ink is not ejected (the ink is adhered). As can be understood from the graphs of FIGS. 7 and 11, when the ink near the nozzle 110 is dried and adhered, a characteristic residual vibration waveform in which the frequency is excessively lowered, and also the residual vibration is excessively decreased compared with the normal ejection can be obtained. This is because after the ink flows from the reservoir 143 into the cavity 141 by gravitating the vibration plate 121 downwardly in FIG. 3 in order to eject ink drops, when the vibration plate 121 moves upwardly in FIG. 3, the ink in the cavity 141 has nowhere to go, and thus the vibration plate 121 cannot quickly vibrate (excessively damped).

Next, the paper dust attachment near an outlet of the nozzle 110 which is still another cause of the dot omission is discussed. In a case in which the paper dust is attached near the outlet of the nozzle 110, the ink leaks through the paper dust from the inside of the cavity 141, and also the ink does not eject from the nozzle 110. In this manner, in a case in which the paper dust is attached near the outlet of the nozzle 110, and the ink leaks from the nozzle 110, when viewed from the vibration plate 121, the ink in the cavity 141 and the leaked ink are more than in the normal state, so it is considered that the inertance m increases. In addition, it is considered that the acoustic resistance r increases by the fiber of the paper dust attached near the outlet of the nozzle 110. Accordingly, a characteristic residual vibration waveform, in which when the paper dust is attached near the outlet of the nozzle 110, the frequency is lower than in the normal ejection, and the frequency of the residual vibration is higher than in the drying of the ink, can be obtained.

Figure 12:
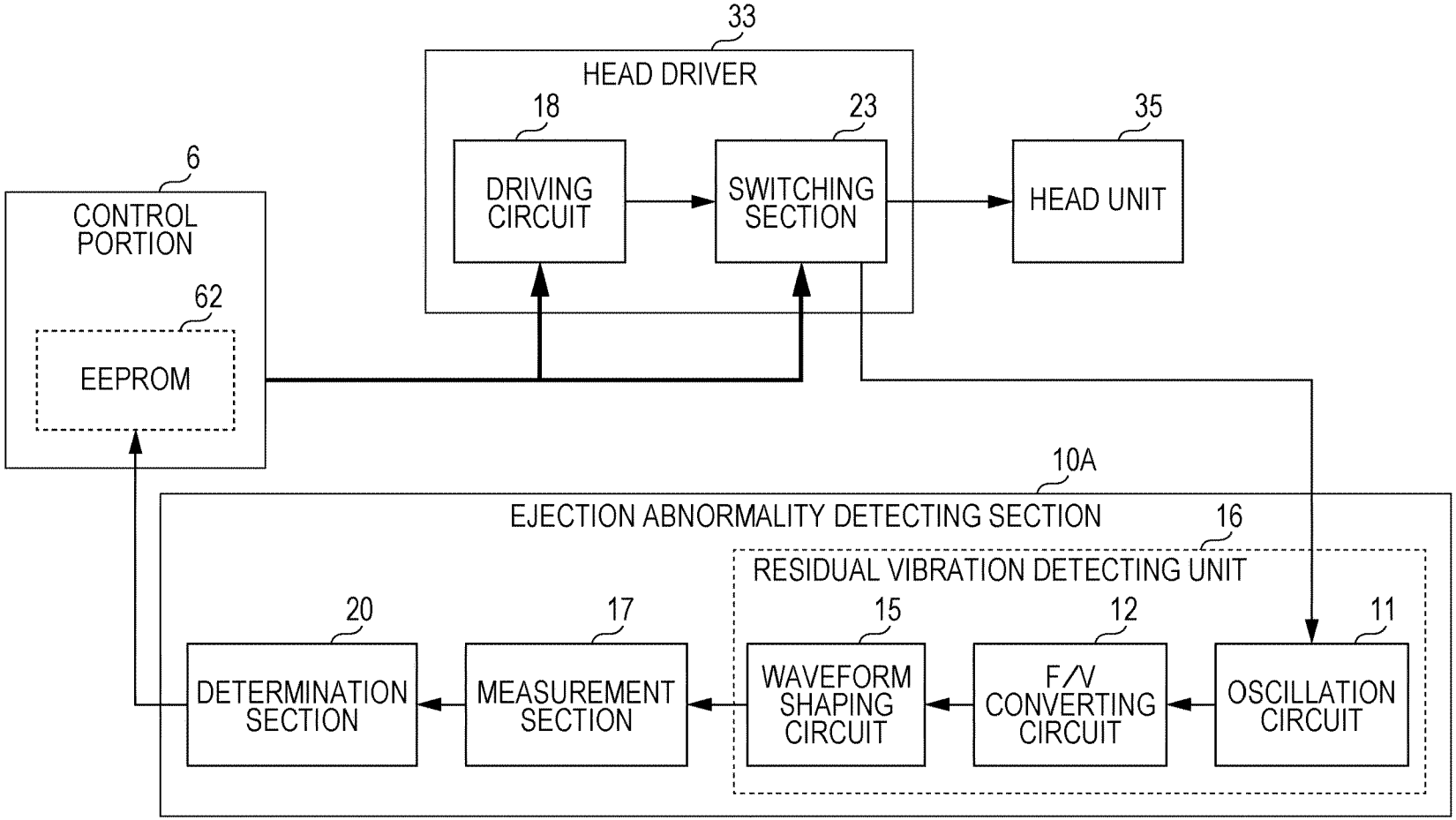
FIG. 12 is a block diagram schematically illustrating an ejection abnormality detecting section.

Next, the ejection abnormality detecting section 10A will be described. FIG. 12 is a block diagram schematically illustrating the ejection abnormality detecting section 10A illustrated in FIG. 3. As illustrated in FIG. 12, the ejection abnormality detecting section 10A includes an oscillation circuit 11, an F/V converting circuit 12, a residual vibration detecting section 16 configured with a waveform shaping circuit 15, a measurement section 17 that measures a cycle, an amplitude, or the like from residual vibration waveform data detected by the residual vibration detecting section 16, and a determination section 20 that determines the abnormal ejection of the ink jet heads 100 based on the cycle or the like measured by the measurement section 17. In the ejection abnormality detecting section 10A, the oscillation circuit 11 oscillates based on the residual vibrations of the vibration plate 121 of the electrostatic actuator 120, the F/V converting circuit 12 and the waveform shaping circuit 15 form vibration waveforms from the oscillation frequency, and the residual vibration detecting section 16 detects the vibration waveforms. Also, the measurement section 17 measures the cycle or the like of the residual vibration based on the detected vibration waveform, and the determination section 20 detects and determines the abnormal ejection of the respective ink jet heads 100 included in the respective head units 35 of the typing section 3 based on the cycle or the like of the measured residual vibration. That is, the ejection abnormality detecting section 10A corresponds to the first detecting section in the invention.

Next, the maintenance unit 72 which performs the maintenance operation of the ink jet head 100 will be described with reference to FIGS. 13 and 14.

Figure 13:
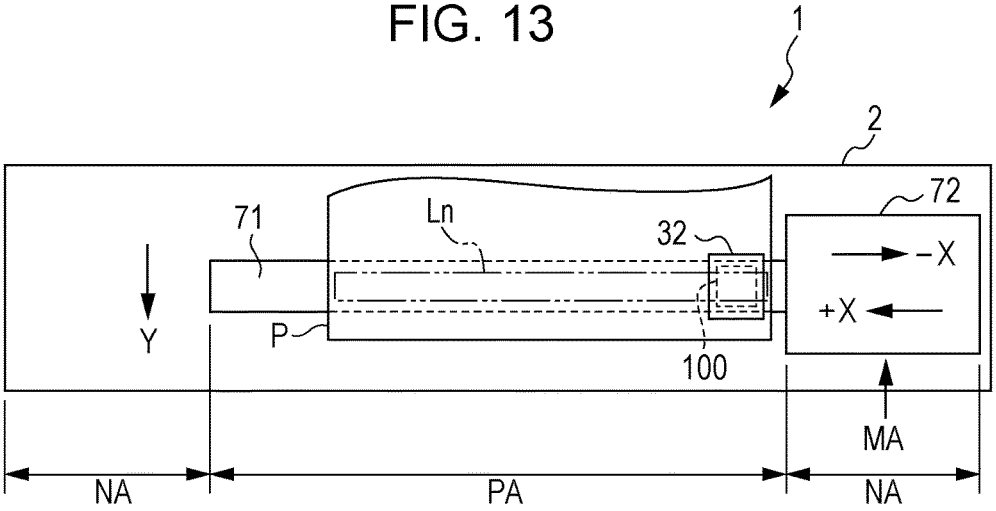
FIG. 13 is a diagram schematically illustrating a configuration of a maintenance unit.

As illustrated in FIG. 13, the printer 1 is provided a supporting stand 71 which supports the recording sheet P inside the apparatus main body 2, and a maintenance unit 72 for performing a maintenance of the ink jet head 100.

The supporting stand 71 is arranged near the center in a scanning area that extends in the main scanning direction of the carriage 32 (in the horizontal direction in FIGS. 13 and 14), while the maintenance unit 72 is arranged in the end portion of the same scanning area. According to the embodiment, a side on which the maintenance unit 72 is arranged in the main scanning direction (right side in FIG. 13) may be referred to as a "1-digit side", and the other side (left side in FIG. 13) may be referred to as an "80-digit side". In addition, the movement direction of the carriage 32 from the 1-digit side to the 80-digit side is referred to as a first scanning direction +X, and the movement direction of the carriage 32 from the 80-digit side to the 1-digit side is referred to as a second scanning direction −X.

The supporting stand 71 may be incorporated with a heat generating body so as to function as a drying mechanism for promoting drying the recording sheet P to which liquid droplets are received. In addition, as the drying mechanism for promoting drying the recording sheet P, the heat generating body that heats the recording sheet P from the upper side of the carriage 32 or a blowing apparatus that blows toward the recording sheet P may be provided.

The area in which the supporting stand 71 is arranged becomes a recording area PA in which liquid droplets are ejected from the ink jet head 100 to the recording sheet P, while the area in which the maintenance unit 72 is arranged becomes a non-recording area NA in which the recording (printing) on the recording sheet P is not performed. Also, after the carriage 32 outwardly moves, for example, the recording area PA in the first scanning direction +X at a substantially constant speed, the carriage 32 is decreased the speed in the non-recording area NA on the 80-digit side, and changes the direction changed at an end portion in the main scanning direction. Also, after the carriage 32 that has changed the direction increases the speed in the non-recording area NA on the 80-digit side, the carriage 32 inwardly moves the recording area PA again in the second scanning direction −X at a substantially constant speed.

That is, the non-recording area NA is also an area in which the reciprocating carriage 32 changes the direction. When performing a recording process, the ink jet head 100 reciprocates between the recording area PA in which the recording sheet P is arranged, and the non-recording area NA which is positioned outside the recording area PA. According to the fifth embodiment, one scanning (movement) of the carriage 32 in the first scanning direction +X or the second scanning direction −X is referred to as one pass, and a belt-shaped area Ln (area indicated with alternate long and two short dashed lines in FIG. 13) in which the recording of the ink jet head 100 can be performed while the carriage 32 performs one pass on the recording sheet P is referred to as one line. In addition, the changing of the direction by the carriage 32 in the non-recording area NA is referred to as a return.

The recording sheet P is arranged on the supporting stand 71, or is retreated from the supporting stand 71 by being transported in a transportation direction Y in the subscanning direction intersecting to the main scanning direction by the paper feeding apparatus 5 (see FIG. 1). The recording sheet P is transported in a predetermined distance (distance corresponding to one line) in the transportation direction Y, while the carriage 32 changes the direction in the non-recording area NA. That is, the printer 1 performs recording on the entire recording sheet P by performing the recording for one line in the recording area PA and the intermittent transportation of the recording sheet P.

Figure 14:
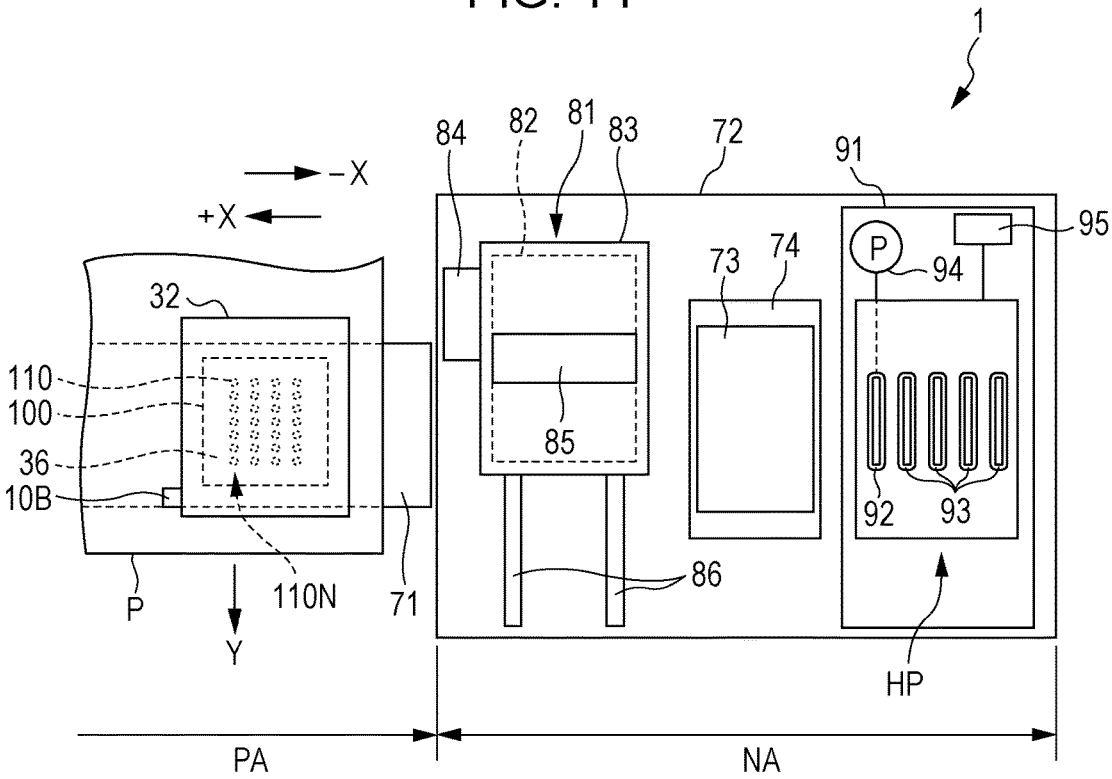
FIG. 14 is a plan view schematically illustrating a part of the maintenance unit of FIG. 13.

As illustrated in FIG. 14, in the ink jet head 100, the plurality of nozzles 110 are lined up in the subscanning direction to form a nozzle array 110N, and also the plurality of nozzle arrays 110N are arranged along the main scanning direction. The plurality of nozzles 110 that configure the nozzle array 110N are nozzles that discharge the same kind of liquid (for example, the same color of ink), and the plurality of nozzle arrays 110N are arrays that discharge different kinds of liquid (for example, ink of different colors: cyan, magenta, yellow, black, and the like).

The maintenance unit 72 arranged in the non-recording area NA on the 1-digit side includes a wiping unit 81, a flushing unit 74 having a liquid receiving portion 73, and a cleaning mechanism 91 which are arranged to be lined up from a position near the recording area PA in the main scanning direction.

The wiping unit 81 includes a wiping member 82 that can absorb liquid, a holding mechanism 83 that holds the wiping member 82, and a wiping motor 84. The wiping member 82 can realize a configuration in which liquid is absorbed in a gap between fibers of synthetic resins, by being formed with, for example, non-woven fabric made of synthetic resins or the like.

The wiping member 82 is detachably attached to the holding mechanism 83. Therefore, the wiping member 82 can be replaced into a new one after use or the like. If the wiping member 82 is attached to the holding mechanism 83, a portion thereof protrudes to the outside, and the wiping member 82 functions as a wiping portion 85 that can wipe a nozzle surface 36 in which the nozzles 110 of the ink jet head 100 are open.

The holding mechanism 83 is supported by a pair of guiding shafts 86 extending in the subscanning direction, and moves in the subscanning direction along the guiding shafts 86 by the driving force of the wiping motor 84 when the wiping motor 84 is driven, so that the wiping portion 85 wipes the nozzle surface 36.

The cleaning mechanism 91 includes at least one cap 92 for suction, a plurality of caps 93 for moisturization, a sucking pump 94, and a capping motor 95. If the capping motor 95 is driven, the caps 92 and 93 relatively move in a direction to be close to the ink jet head 100 so that a closed space the plurality of nozzles 110 that form the nozzle array 110N are closed is formed.

The cap 92 for suction forms a closed space in which a portion (for example, the nozzles 110 that eject the same kind of liquid) of the plurality of nozzles 110 is open. Also, if the sucking pump 94 is driven in a state in which the cap 92 for suction forms the closed space, the closed space becomes the negative pressure, and the suction cleaning (pump suction process) in which the ink is ejected from the nozzles 110 which are open to the closed space is performed. The suction cleaning is a kind of maintenance operations which is performed in order to solve the abnormal ejection of the nozzles 110, and is performed for each nozzle group enclosed with the cap 92 for suction.

The caps 93 for moisturization suppress the nozzles 110 from being dried by forming closed spaces to which the nozzles 110 are open. For example, the caps 93 for moisturization are provided for each nozzle array 110N, and form closed spaces in a shape of dividing the plurality of nozzles 110 in the nozzle array unit. Also, a configuration of the caps 93 for moisturization will be described later in detail.

When the recording is not performed, or the electric power is turned off, the ink jet head 100 is moved to a stand-by position HP in which the caps 93 for moisturization are arranged. Then, the caps 93 for moisturization relatively move in a direction to come to close to the ink jet head 100 to form the closed spaces to which the nozzles 110 are open. In this manner, enclosing a space to which the nozzles 110 are open by the cap 92 or the caps 93 is referred to as capping. Also, when the recording is not performed, the ink jet head 100 is capped by the caps 93 for moisturization in the stand-by position HP.

In addition, when the ink jet head 100 is arranged in a position corresponding to the liquid receiving portion 73 (for example, upper side of the liquid receiving portion 73 in the vertical direction), the ink jet head 100 performs a flushing process for ejecting liquid droplets to the liquid receiving portion 73.

According to the fifth embodiment, the clogging of the nozzles 110 is prevented or solved by performing the flushing operation in which the ink jet head 100 periodically ejects the liquid droplets to the liquid receiving portion 73 when performing the recording process on the recording sheet P. In the description below, the flushing which is periodically performed in the non-recording area NA between the recording operations in the recording area PA is distinguished from the flushing as a restoration operation (maintenance operation) when the ink is thickened, and is referred to as periodic flushing.

Further, the periodic flushing may be performed whenever the ink jet head 100 once reciprocates in the scanning area, and arranged in the position corresponding to the liquid receiving portion 73, or whenever the ink jet head 100 reciprocates a plurality of times. In addition, in one time of periodic flushing, the liquid droplets may be ejected from a portion of the nozzles 110, and the liquid droplets may be ejected from all the nozzles 110.

Next, the RGB camera 10B will be described with reference to FIG. 14. As illustrated in FIG. 14, the RGB camera 10B is provided on one end portion (an end portion of a left side in FIG. 14) of the carriage 32 in the main scanning direction, and detects the ejection state of the liquid droplets by reading a pattern which is formed on the recording sheet P by ejecting the liquid droplets from the nozzle 110. That is, the RGB camera 10B corresponds to the second detecting section in the invention. The RGB camera 10B is capable of reading a color image by RGB color separation. The control portion 6 determines that the ejection state of the ink is not normal in a case in which a quality of the pattern formed on the recording sheet P detected by the RGB camera 10B exceeds a predetermined allowable amount (for example, in a case in which the landing position of the ink is not in a predetermined area).

Here, the caps 93 for moisturization will be described with reference to FIGS. 15 to 19.

Figure 15:
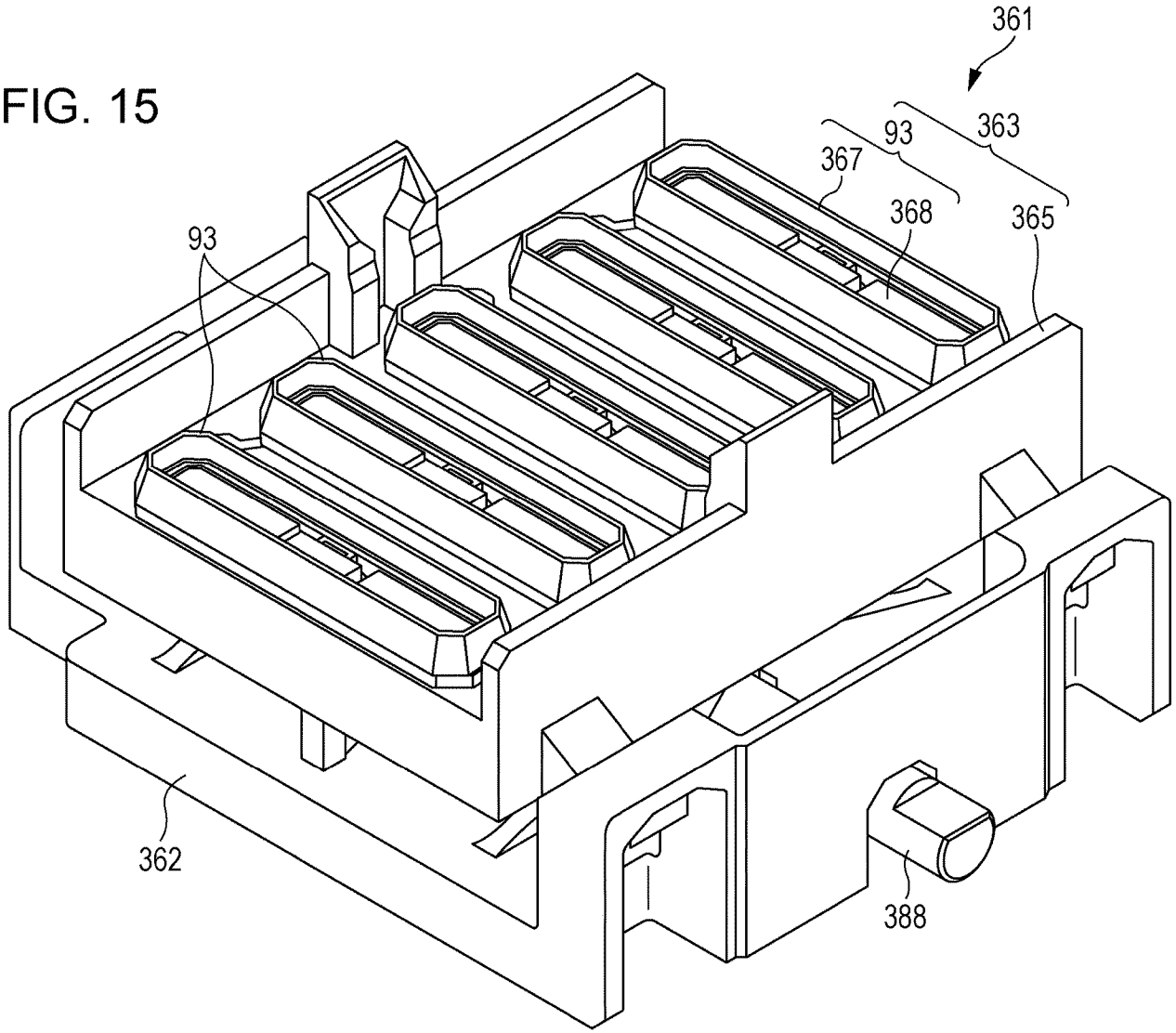
FIG. 15 is a perspective view illustrating a moisturizing mechanism.

As illustrated in FIG. 15, a moisturizing mechanism 361 as an example of a maintenance unit includes a cap holder 362 and a moisturizing cap 363 held by the cap holder 362. The moisturizing cap 363 includes the cap 93 as an example of a cap section, which comes into contact with the head unit 35 and closes the space 263 (see FIG. 18) which the nozzle 110 faces, and a support portion 365 that supports at least one cap 93.

The caps 93 for moisturization are arranged at intervals in the scanning direction of the carriage 32 to correspond to the nozzle arrays 110N (not illustrated in FIG. 15) of the head unit 35 and the number of caps 93 for moisturization is the same as that of nozzle arrays 110N. Also, each of the caps 93 includes a frame 367 which is made of an elastic material such as an elastomer and substantially has an oblong shape in a plan view, and a rigid member 368 fit into the frame 367.

Figure 16:
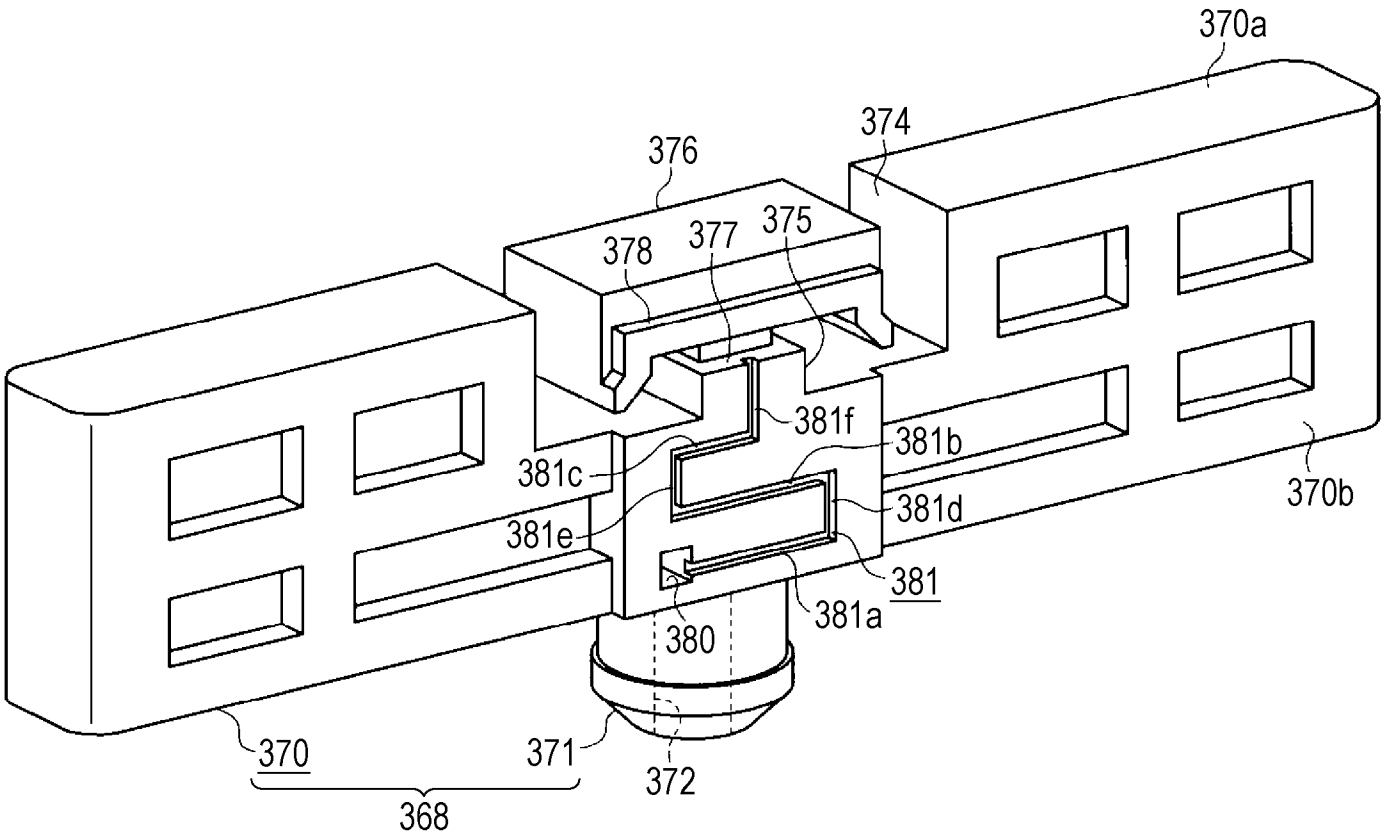
FIG. 16 is a perspective view illustrating a rigid member.
Figure 17:
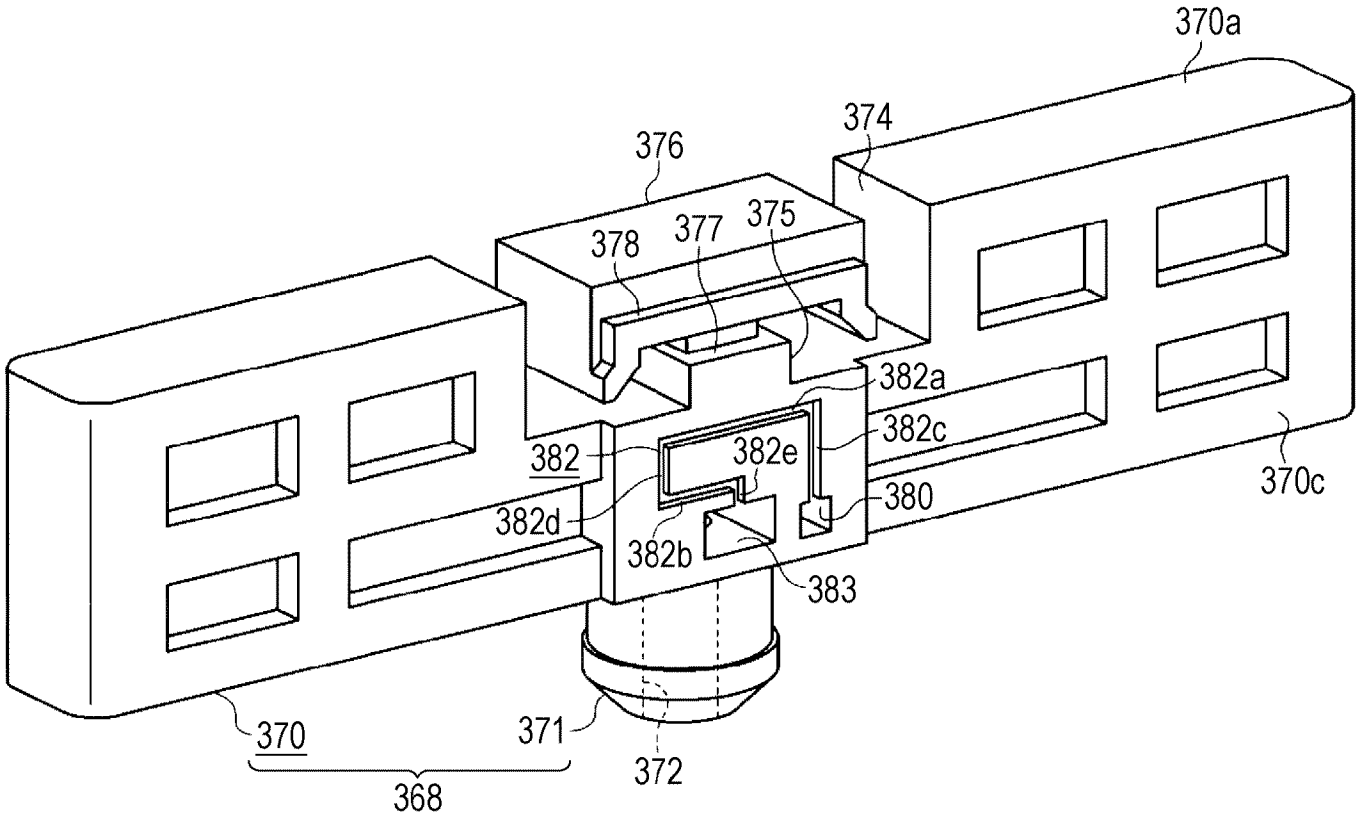
FIG. 17 is a perspective view illustrating the rigid member.

As illustrated in FIGS. 16 and 17, the rigid member 368 is configured of a hard synthetic resin having high gas barrier properties such as polypropylene (PP). Further, as a material of the rigid member 368, any hard materials having high gas barrier properties can be employed, and, for example, polyethylene (PE), polyethylene terephthalate (PET), or the like may be employed.

The rigid member 368 has a main body 370 substantially having a rectangular parallelepiped and a protrusion section 371 which protrudes from the main body 370 and has a circular tube shape. That is, the protrusion section 371 has a hollow portion 372 inside.

Also, in the following description, a surface of the main body 370, on which the protrusion section 371 is formed, is referred to as an under surface and a surface opposite to the under surface is referred to as a top surface 370*a*. That is, the top surface 370*a* means a surface which configures an inner bottom of the cap 93 in a case in which the rigid member 368 is fitted into the frame 367. Also, longitudinal and traverse directions mean directions intersecting with the vertical direction and direction of the long side and short side of the main body 370, respectively. Moreover, of the side surfaces of the main body 370, one of both side surfaces in the traverse direction is referred to as a first side surface 370*b* and the other surface is referred to as a second side surface 370*c*.

A recessed section 374 is formed in the top surface 370*a* of the main body 370 at the center position in the longitudinal direction across the traverse direction. A convex portion 375 extending in the traverse direction and a cover section 376 substantially having a rectangular plate shape in a plan view are formed on the inner bottom of the recessed section 374 to be integral to the main body 370. Further, an annular concave portion 377 is formed on the boundary between the convex portion 375 and the cover section 376.

Step portions 378 are formed on both side surfaces of the cover section 376 in the traverse direction, respectively. Further, both ends of the step portion 378 in the longitudinal direction is bent at a right angle downward and inclined to become wider obliquely downward.

As illustrated in FIG. 16, a through-hole 380 which penetrates the main body 370 from the first side surface 370*b* in the traverse direction is formed. Moreover, a first groove 381 which connects the through-hole 380 and the annular concave portion 377 is formed to meander on the first side surface 370*b*.

That is, the first groove 381 is configured to have first to third longitudinal grooves 381*a* to 381*c* extending in the longitudinal direction and first to third vertical grooves 381*d* to 381*f* extending in the vertical direction. Further, the first to third longitudinal grooves 381*a* to 381*c* are formed at positions different in the vertical direction and the first to third vertical grooves 381*d* to 381*f* are formed at positions different in the longitudinal direction and the vertical direction.

Specifically, the first longitudinal groove 381*a* connects the through-hole 380 and the lower end of the first vertical groove 381*d*. Also, the second longitudinal groove 381*b* connects the upper end of the first vertical groove 381*d* and the lower end of the second vertical groove 381*e*, and the third longitudinal groove 381*c* connects the upper end of the second vertical groove 381*e* and the lower end of the third vertical groove 381*f*. Moreover, the upper end of the third vertical groove 381*f* faces the under surface of the cover section 376.

As illustrated in FIG. 17, a second groove 382, whose one end is connected to the through-hole 380, is formed and a connection hole 383 which connects the other end of the second groove 382 and the hollow portion 372 is formed, on the second side surface 370*c*. That is, the second groove 382 is formed to meander so as to connect the through-hole 380 and the connection hole 383.

Further, the second groove 382 is configured to have a fourth longitudinal groove 382*a* and a fifth longitudinal groove 382*b* which extend in the longitudinal direction and fourth to sixth vertical grooves 382*c* to 382*e* which extend in the vertical direction. The fourth longitudinal groove 382*a* and the fifth longitudinal groove 382*b* are formed at positions different in the vertical direction and the fourth to sixth vertical grooves 382*c* to 382*e* are formed at positions different in the longitudinal direction.

Specifically, the lower end of the fourth vertical groove 382*c* is connected to the through-hole 380. Also, the fourth longitudinal groove 382*a* connects the upper end of the fourth vertical groove 382*c* and the upper end of the fifth vertical groove 382*d* and the fifth longitudinal groove 382*b* connects the lower end of the fifth vertical groove 382*d* and the upper end of the sixth vertical groove 382*e*. In addition, the lower end of the sixth vertical groove 382*e* is connected to the connection hole 383.

Figure 18:
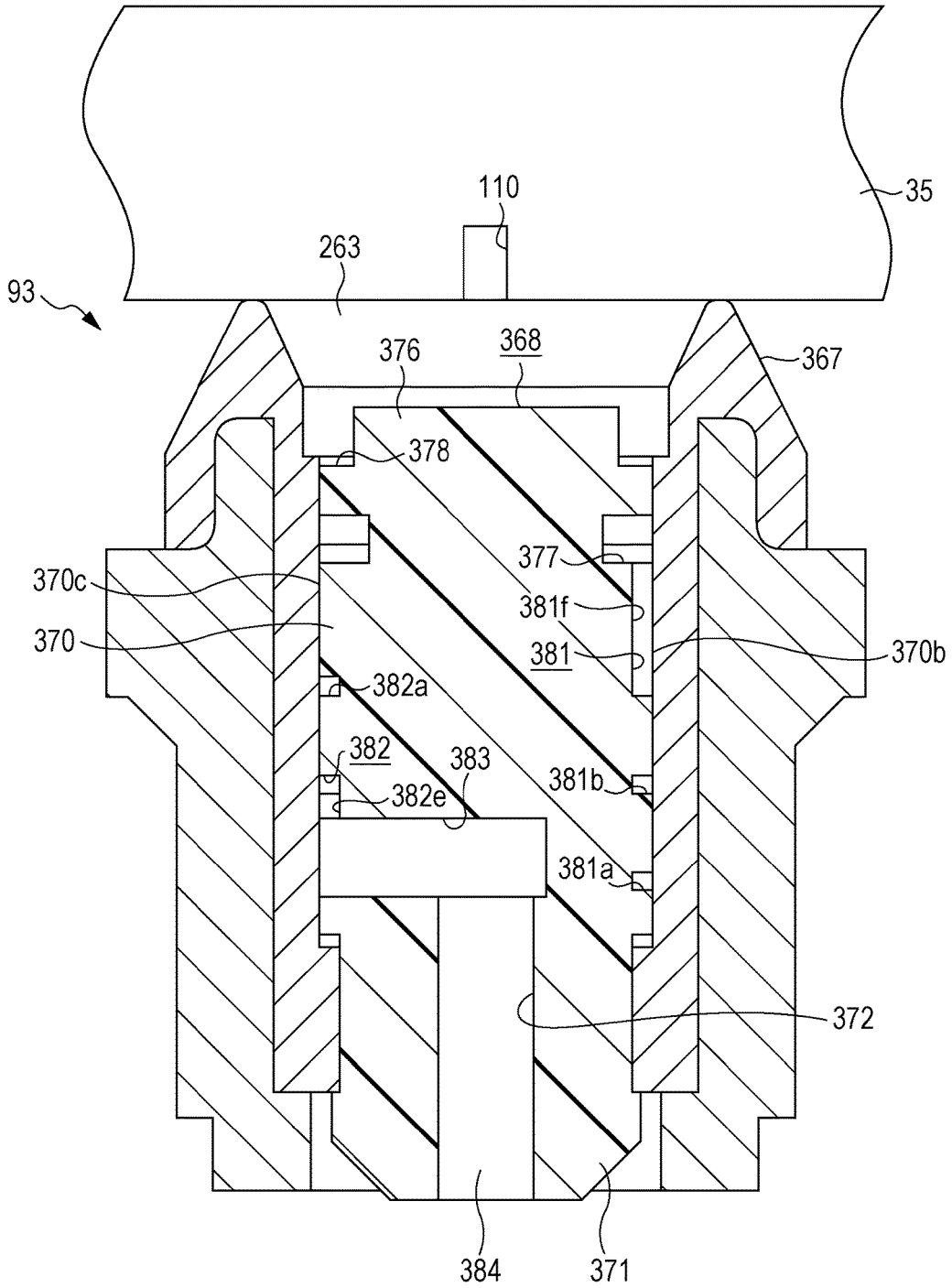
FIG. 18 is a cross-sectional view illustrating a cap.

As illustrated in FIG. 18, in a case in which the rigid member 368 is mounted in the frame 367, the first side surface 370*b* and the second side surface 370*c* of the rigid member 368 comes into close contact with an inner surface of the frame 367. Accordingly, openings of the first groove 381, the second groove 382, the through-hole 380, and the connection hole 383 are covered with the inner surface of the frame 367 and the grooves and the hole becomes an air path. A gap between the main body 370 and the cover section 376 becomes an air path. Accordingly, the air paths and the hollow portion 372 configure an air communicating section 384 through which the airtight space 263, which the nozzle 110 faces, and air communicate with each other. Further, the airtight space 263 means a space, which the nozzle 110 faces and which is closed, when the cap 93 comes into contact with the head unit 35. Also, the moisturizing mechanism 361 performs a capping operation as an example of the maintenance operation of the head unit 35, with the cap 93 coming into contact with the head unit 35 and closing the space 263 which the nozzle 110 faces. In addition, when the liquid is attached and dries in the air communicating section 384, for example, the moisturizing cap 363, as an expendable item, malfunctions and it is not possible to perform complete closing of the airtight space 263 in a state in which the airtight space 263, which the nozzle 110 faces, communicates with air.

Figure 19:
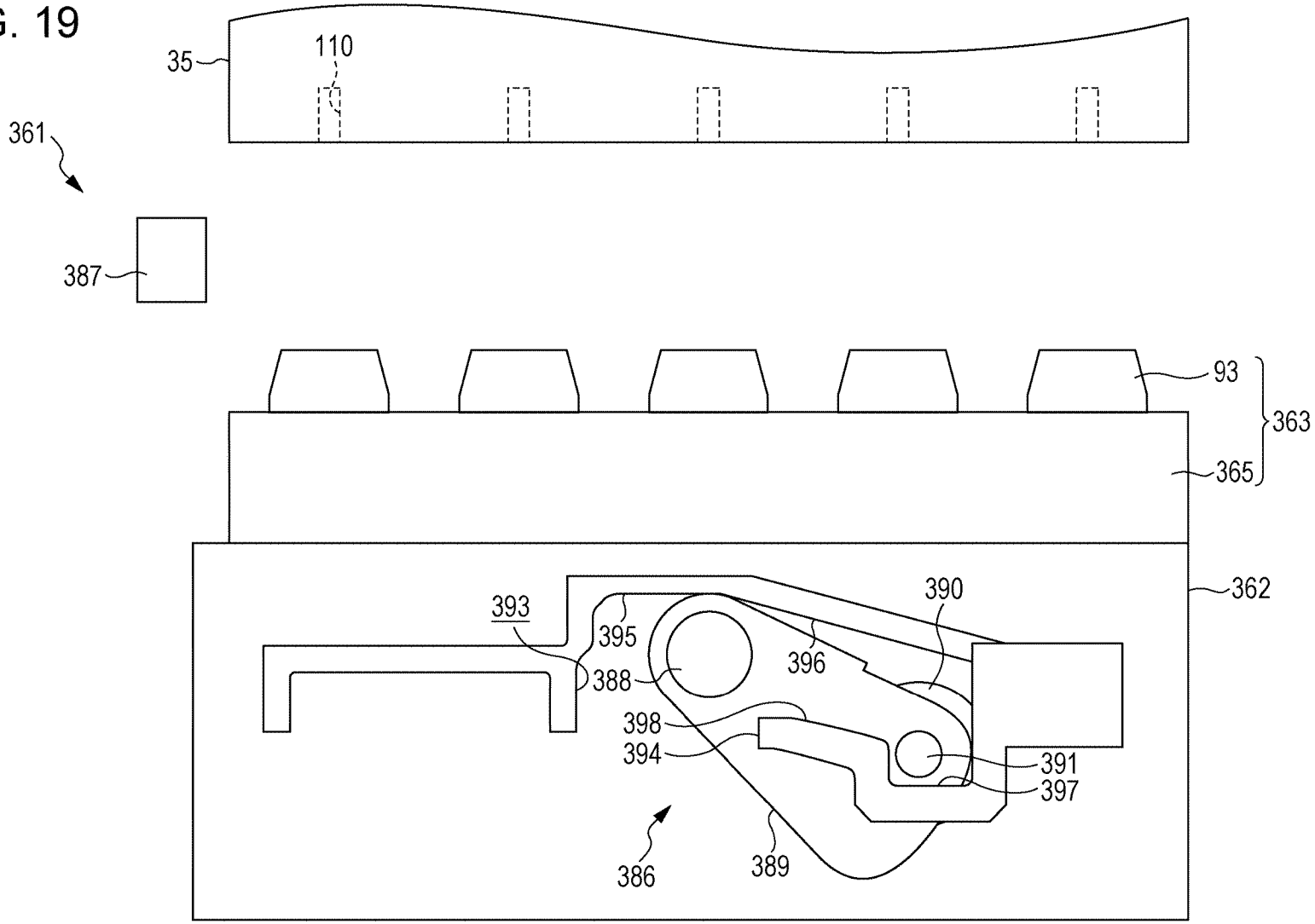
FIG. 19 is a diagram schematically illustrating the moisturizing mechanism positioned on the lower side.

As illustrated in FIG. 19, the moisturizing mechanism 361 includes a cam mechanism 386 which causes the cap holder 362 to be lifted and lowered and thereby enables the cap 93 to come into contact with or to be separated from the head unit 35. That is, the moisturizing cap 363 and the cap holder 362 are configured to be able to be integrally lifted and lowered by the cam mechanism 386. In addition, the moisturizing mechanism 361 has a regulation section 387 which comes into contact with the lifted cap holder 362 and regulates a movement thereof.

The cam mechanism 386 has a rotating shaft 388 which rotates by rotary drive of the capping motor 95 (see FIG. 14) and a cam frame 389 which substantially has a triangular shape and is fixed to a base end section of the rotating shaft 388. In addition, a shaft 391 of a cam roller 390 is pivotally supported by a distal end portion of the cam frame 389 in a rotatable manner. The shaft 391 of the cam roller 390 is configured to penetrate the cam frame 389 and to protrude from both side surfaces of the cam frame 389. Accordingly, when the cam frame 389 rotates around the rotating shaft 388 along with the rotation of the rotating shaft 388, the cam roller 390 pivotally supported on the distal end portion of the cam frame 389 performs a circular motion around the rotating shaft 388.

In addition, a cam groove 393 is formed at a position on the cap holder 362, which corresponds to the cam mechanism 386. The cam groove 393 has an opening 394 which opens downward and the cap holder 362 is supported by the cam mechanism 386 when the cam mechanism 386 is inserted through the opening 394.

More specifically, the cam groove 393 of the cap holder 362 has a flat surface section 395 which is positioned above the opening 394 and a first inclined surface section 396 continuous from the flat surface section 395. Further, a concave surface section 397 and a second inclined surface section 398 continuous from the concave surface section 397 are formed at positions on the cam groove 393, which can come into contact with both ends of the shaft 391. Further-more, the first inclined surface section 396 and the second inclined surface section 398 are formed to have gradients which are substantially parallel to each other.

Next, a malfunction detecting process of the moisturizing cap 363 will be described. Also, the malfunction detecting process of the moisturizing cap 363 is performed on the regular basis or based on an instruction by a user.

Firstly, the control portion 6 detects the vibration waveform of the cavity 141 before the cap 93 closes a space using the ejection abnormality detecting section 10A after performing the suction cleaning. Subsequently, the control portion 6 causes the caps 93 for moisturization to come into close contact with the head unit 35. That is, the control portion 6 causes the carriage 32 to be moved by inputting a signal to the carriage motor driver 43, and causes the nozzle 110 to correspond to the cap 93. Also, the control portion 6 drives the capping motor 95 to cause the rotating shaft 388 to rotate in the forward direction, the cap 93 is lifted, and thereby the capping operation is performed.

Subsequently, the control portion 6 causes the cap 93 for moisturization to be opened. That is, the control portion 6 drives the capping motor 95 to cause the rotating shaft 388 to rotate in the backward direction and the cap 93 is lowered. Subsequently, the control portion 6 detects the vibration waveform of the cavity 141 after the cap 93 which closes the space opens the space using the ejection abnormality detecting section 10A. Then, the control portion 6 determines whether or not bubbles are mixed in the nozzle 110 or the cavity 141 by compared the two vibration waveforms. In a case where the bubbles are not increased in the nozzle 110 or in the cavity 141, the control portion 6 ends the malfunction detecting process of the cap 93.

Meanwhile, the control portion 6 determines the air communicating section 384 malfunctions in a case in which the number of the cavities 141 in which the bubbles are mixed is increased by a test after the cap 93 which closes the space opens the space more than the number of cavities 141 in which the bubbles are mixed by a test before the cap 93 closes the space, causes the operation panel 7 as an example of the notification unit display the gist for a replacement necessity of the caps 93 for moisturization, and ends the malfunction detecting process of the cap 93.

Figure 20:
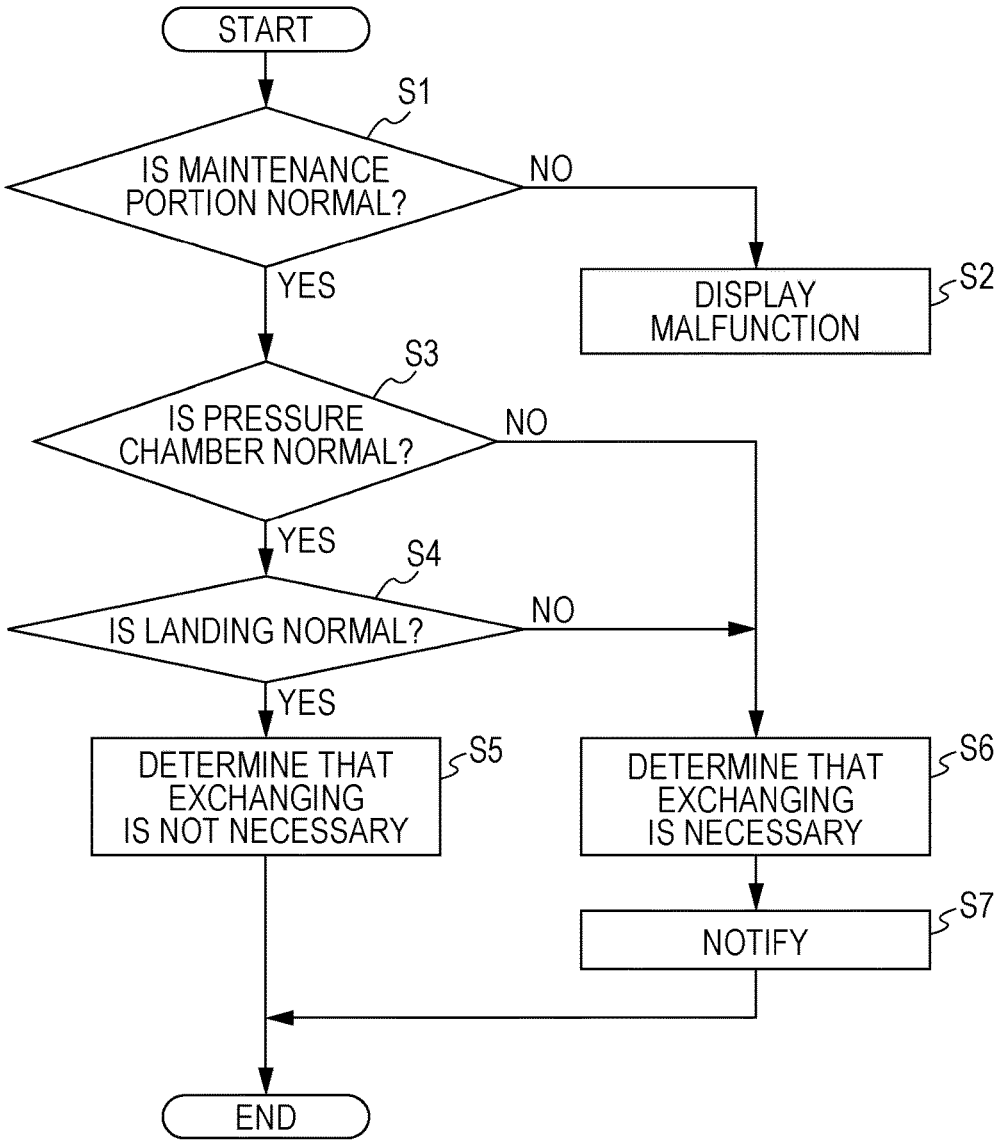
FIG. 20 is a flow chart illustrating a method of determining a replacement necessity of an ink jet head according to the embodiment of the invention.

Next, a method of determining a replacement necessity of the ink jet head 100 will be described with reference to a flow chart of FIG. 20. The control portion 6 of the printer 1 according to the embodiment checks that the maintenance unit 72 normally functions, and then determines the replacement necessity of the ink jet head 100.

That is, first, the control portion 6 detects the vibration waveform of the cavity 141 before the maintenance operation using the ejection abnormality detecting section 10A, detects the vibration waveform of the cavity 141 either of during the maintenance operation or after the maintenance operation, based on the detected vibration waveform, and determines whether or not the bubbles inside the cavity 141 is increased by the maintenance operation (maintenance unit normality determining process: S1). In the maintenance unit normality determining process S1, the control portion 6 is capable of employing the malfunction detecting process of the cap 93 or the like described above.

In the maintenance unit normality determining process S1, in a case in which the bubbles in the cavity 141 are determined to be increased by the maintenance operation, the control portion 6 determines that the maintenance unit 72 malfunctions, and causes the operation panel 7 to display the gist thereof (malfunction displaying process: S2). Meanwhile, in the maintenance unit normality determining process S1, in a case in which the bubbles in the cavity 141 are determined to be not increased by the maintenance operation, the control portion 6 determines whether or not an abnormality of the state inside the cavity 141 is detected by the ejection abnormality detecting section 10A predetermined number of times (pressure chamber abnormality determining process: S3), and determines whether or not a normality of the ejection state of the ink is detected by the RGB camera 10B predetermined number of times (landing abnormality determining process: S4).

Also, in a case in which the state inside the cavity 141 is determined to be normal (or the abnormality is detected less than predetermined number of times) in the pressure chamber abnormality determining process S3, and the ejection state of the ink is determined to be normal (or the abnormality is detected less than predetermined number of times) in the landing abnormality determining process S4, the control portion 6 determines replacement of the ink jet head 100 is not necessary (replacement unnecessity determining process: S5), and ends the control.

Meanwhile, in a case in which it is determined that the abnormality of the state inside the cavity 141 is detected predetermined number of times in the pressure chamber abnormality determining process S3, and/or, the abnormality of the ejection state of the ink is detected predetermined number of times in the landing abnormality determining process S4, the control portion 6 determines a replacement of the ink jet head 100 is necessary (replacement necessity determining process: S6), and causes the operation panel 7 to display the gist so as to notify the operator (replacement information displaying process: S7). After that, the control is ended.

Configuration of Remote Monitoring System

Next, using FIG. 21, the printer 1 according to the embodiment will be described as an example of a remote monitoring system through a network.

Figure 21:
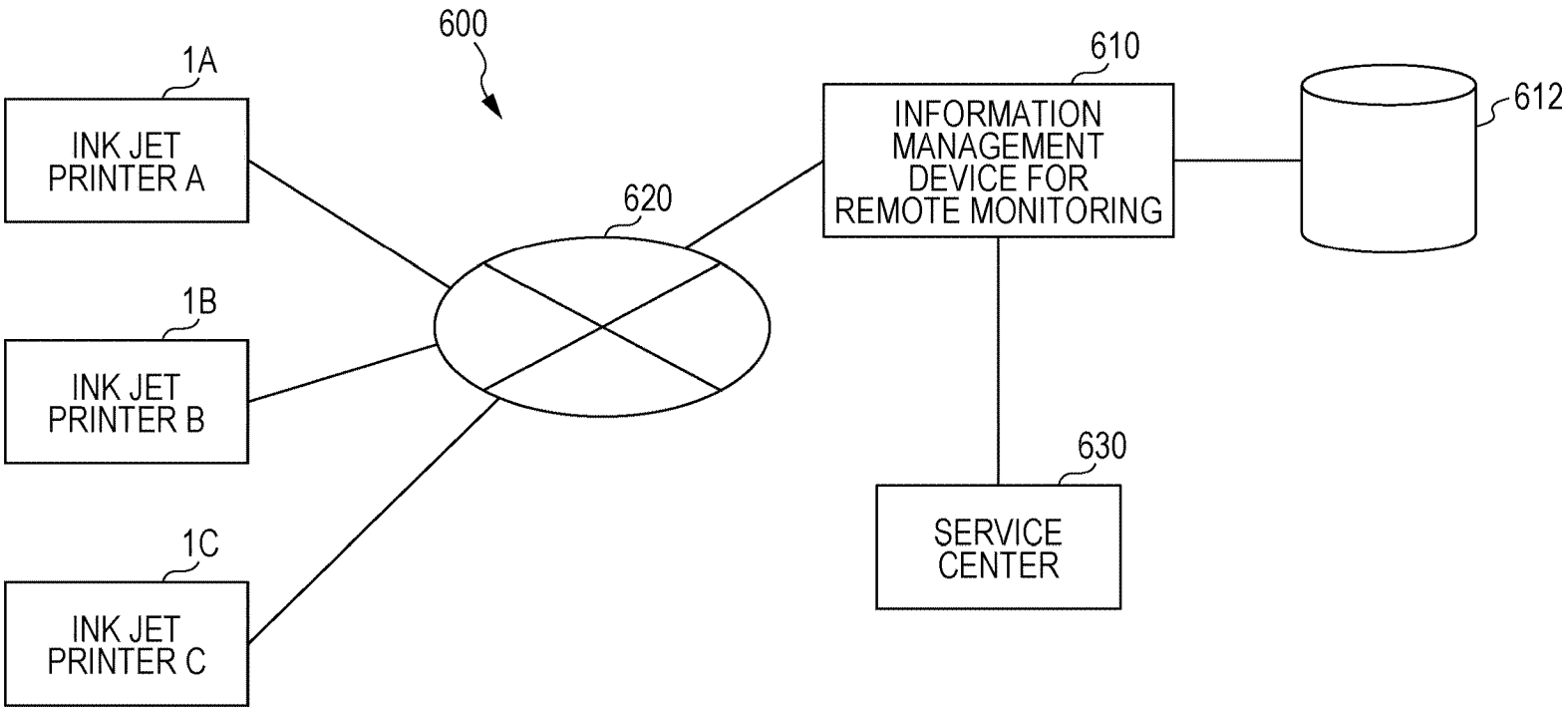
FIG. 21 is a diagram illustrating a configuration of a remote monitoring system.

FIG. 21 is a diagram illustrating a configuration of a remote monitoring system 600. Here, a centralized system of a plurality of printers 1A, 1B, and 1C using a computer of a remote monitoring center (hereinafter, referred to as an "information management device for remote-monitoring") 610 is exemplified. Also, three of the printers 1A, 1B, and 1C are illustrated in FIG. 21, but the number of printers to be monitored is not particularly limited.

Each of the printers 1A, 1B, and 1C is communicably connected to the information management device for remote-monitoring 610 through a communication line 620. An aspect of the communication line 620 is not particularly limited, and may be a local LAN, or may be a wide area communication network (WAN) such as Internet. A communication method is not particularly limited, and may be a wired or wireless manner or may be a combination thereof.

Each of the printers 1A, 1B, and 1C is provided with a communicating section 500 (FIG. 2) which is communicably connected to the information management device for remote-monitoring 610 as an external device, and is configured to be capable of transmitting information relating to the state inside the cavity 141 detected by the ejection abnormality detecting section 10A and information relating to the ejection state of the ink detected by the RGB camera 10B to the information management device for remote-monitoring 610 through the communication line 620.

The information management device for remote-monitoring 610 stores information collected from each of the printers 1A, 1B, and 1C to a storage device 612, and collects and manages information relating to the state inside the cavity 141 detected by the ejection abnormality detecting section 10A and information relating to the ejection state of the ink detected by the RGB camera 10B by device and model. The information management device for remote-monitoring 610 calculates a time t (time taken for generating the abnormal ejection once) used for calculating prediction of generation of the abnormal ejection based on the collected information, and provides the information to each of the printers 1A, 1B, and 1C as needed. Accordingly, each of the printers 1A, 1B, and 1C is capable of predicting generation of the abnormal ejection using the newest parameter.

The information management device for remote-monitoring 610 is communicably connected to a computer of a service center (hereinafter, referred to as a "service center device".) 630 which provides a maintenance service. The information management device for remote-monitoring 610 is provided with a maintenance service request information generating section which generates information for requesting a necessity of a call for a service man, with respect to the printers 1A, 1B, and 1C which are determined to be required to replace the ink jet head 100, based on the state inside the cavity 141 detected by the ejection abnormality detecting section 10A and the ejection state of the ink detected by the RGB camera 10B. The information management device for remote-monitoring 610 transmits the information generated by the maintenance service request information generating section to the service center device 630.

The service center device 630 generally manages the maintenance request information, and supports a task of dispatching a service man. In this way, the service man is dispatched from the service center to the corresponding device, and performs a required maintenance work such as a head replacement.

Also, the information management device for remote-monitoring 610 and the service center device 630 may be connected to each other by a local LAN, and may be connected to each other by a wide area network (WAN) such as Internet. In addition, an aspect in which the information management device for remote-monitoring 610 and the service center device 630 are realized by a common computer is possible.

In the printer 1 according to the embodiment described above, the ejection abnormality detecting section 10A (the first detecting section) is capable of detecting the state inside the cavity 141, and the RGB camera 10B (the second detecting section) is capable of detecting the ejection state of the liquid droplets (amount of landing deviation). Also, after the maintenance operation by the maintenance unit 72, in a case in which at least either of the abnormality of the state inside the cavity 141 or the abnormality of the ejection state of the liquid droplets from the nozzle 110 is detected predetermined number of times, replacement of the ink jet head 100 can be determined to be necessary. Accordingly, with reference to the two detected results, necessity of the replacement of the ink jet head 100 can be accurately determined.

In addition, in the printer 1 according to the embodiment described above, in a case in which the control portion 6 determines that the replacement of the ink jet head 100 is necessary, the gist thereof can be notified to an operator (for example, a user or a service man) using the operation panel 79 (notification unit).

In addition, in the printer 1 according to the embodiment described above, the control portion 6 is capable of checking that the maintenance unit 72 normally functions, and then determining that replacement of the ink jet head 100 is necessary. When the maintenance unit 72 does not normally function, the detecting section (the ejection abnormality detecting section 10A and the RGB camera 10B) cannot accurately detect the state of the ink jet head 100, or the nozzle 110 or the state inside the cavity 141 may be deteriorated. When the configuration of the embodiment is employed, the maintenance unit 72 is checked to normally function, and then a replacement necessity of the ink jet head 100 can be determined. Thus, it is possible to perform determination based on the accurate detection result, and to prevent deterioration of the nozzle 110 or the state inside the cavity 141.

In addition, in the printer 1 according to the embodiment described above, in a case in which increase of the bubbles in the cavity 141 is determined by the maintenance operation based on the vibration waveform detected by the ejection abnormality detecting section 10A, it is possible to assume that bubbles are mixed from the nozzle 110 in accordance with the maintenance operation. Accordingly, it is possible to determine that the maintenance unit 72 performed the maintenance operation malfunctions.

In addition, in the printer 1 according to the embodiment described above, the ejection abnormality detecting section 10A detects the vibration waveform of the cavity 141 before the cap 93 closes a space, and detects the vibration waveform of the cavity 141 after the cap 93 which closed the space opens the space, in a case in which a change of the state inside the cavity 141 indicates the increase of the bubbles inside the cavity 141, the control portion 6 is capable of determining that the air communicating section 384 malfunctions. The air communicating section 384 may not perform a function of communicating between a space closed with the cap 93 which is a space that the nozzle 110 faces and the air, for example, due to attachment and solidification of the liquid. Also, when the space, which the nozzle 110 faces, becomes airtight with the moisturizing cap 363 in which the air communicating section 384 insufficiently functions, a pressure in the airtight space is increased and air is likely to be mixed from the nozzle 110. In this case, according to this configuration, it is possible to determine that the air communicating section 384 malfunctions, by detecting whether there is an increase in the bubbles from the state before the cap 93 comes into contact with the ink jet head 100 and the space, which the nozzle 110 faces, becomes airtight, to the state after the space is opened.

In addition, in the remote monitoring system 600 according to the embodiment described above, even when the system is positioned to be distant away from the printers 1A, 1B, and 1C, a replacement necessity of the ink jet head 100 can be determined based on information relating to the state inside the cavity 141 detected by the ejection abnormality detecting section 10A and information relating to the ejection state of the ink detected by the RGB camera 10B (amount of landing deviation).

In addition, the remote monitoring system 600 according to the embodiment described above is provided with the maintenance service request information generating section which generates information for requesting a call for a service man with respect to the printers 1A, 1B, and 1C which are determined to be necessary to replacement of the ink jet head 100 based on the state inside the cavity 141 detected by the ejection abnormality detecting section 10A and the ejection state of the ink detected by the RGB camera 10B. Therefore, in a case in which the replacement of the ink jet head 100 is determined to be necessary, a call for a service man can be requested, and thus it is possible to provide an appropriate maintenance service.

Second Embodiment

Next, a printer 1 according to a second embodiment of the invention will be described with reference to FIG. 22.

Figure 22:
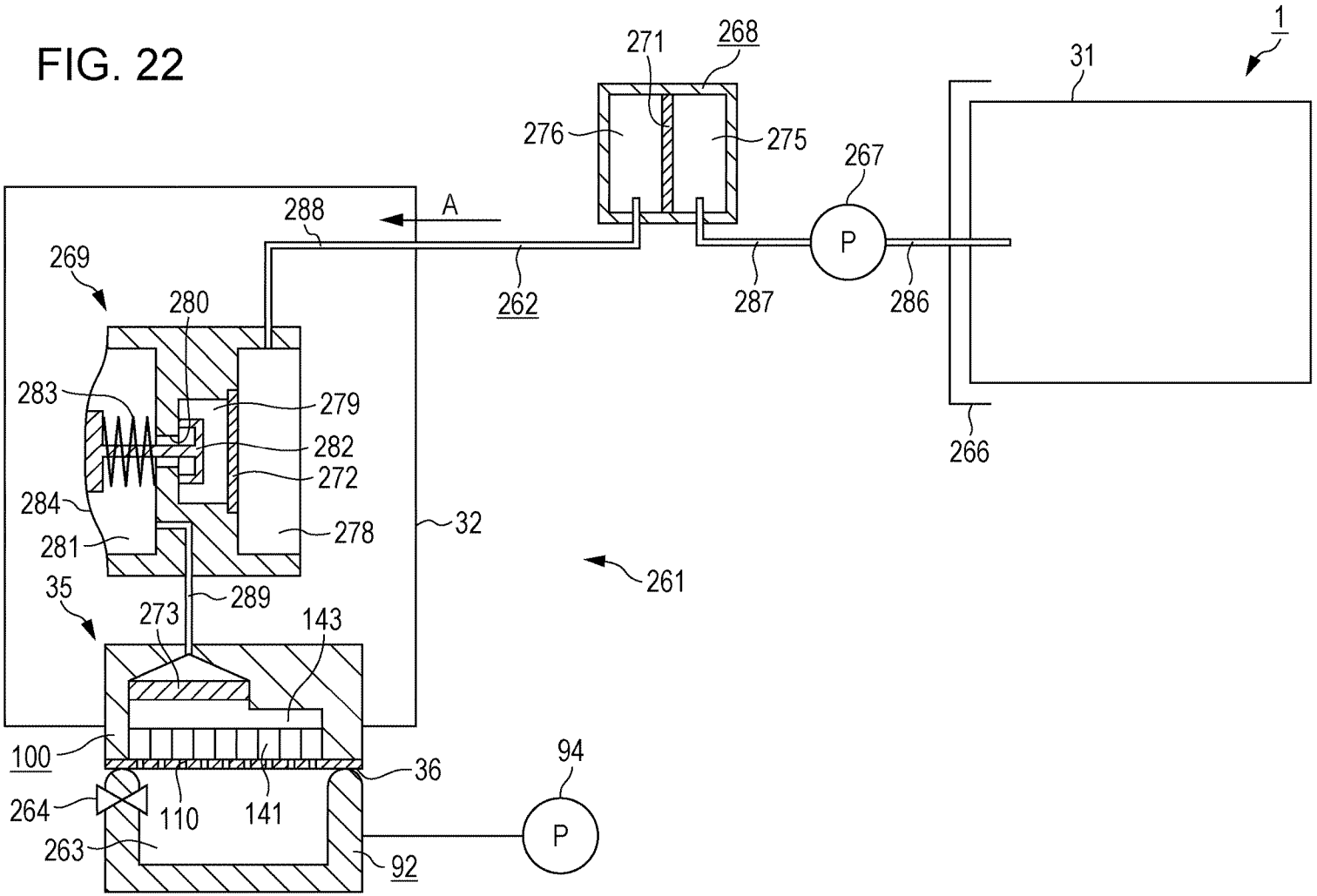
FIG. 22 is a diagram schematically illustrating a configuration of a printer according to a second embodiment of the invention.

As illustrated in FIG. 22, the printer 1 according to the embodiment is provided with the head unit 35, and at least one supply mechanism 261 which can supply the liquid (for example, ink) contained in the ink cartridge 31 as an example of a liquid supply source, to the head unit 35. That is, the supply mechanism 261 supplies the liquid from the ink cartridge 31 through a liquid supply path 262 to the head unit 35. Also, the head unit 35 has the plurality of nozzles 110 from which the liquid supplied by the supply mechanism 261 is ejected as the liquid droplets, ejects the liquid droplets from the nozzles 110 to the recording sheet P (see FIG. 1) as an example of a medium, and performs a recording process.

Also, the ink cartridge 31 according to the embodiment is not mounted in the carriage 32 but is disposed at a place other than the carriage 32. Also, even in a case in which a plurality of supply mechanisms 261 are provided, a configuration of each supply mechanism 261 is the same, and thus FIG. 22 illustrates one supply mechanism 261 and description of other supply mechanisms are omitted.

In addition, as illustrated in FIG. 3, the head unit 35 includes the electrostatic actuator 120 as an example of an actuator which causes the cavity 141 as an example of a pressure chamber communicating with the nozzle 110 to vibrate. That is, the head unit 35 drives the electrostatic actuator 120 to cause the cavity 141 to vibrate, and thereby causes the liquid droplets to be ejected from the nozzle 110. Also, the control portion 6 (see FIG. 2) detects a vibration waveform of the cavity 141 vibrated by driving of the electrostatic actuator 120, and thereby making it possible to detect a state of the cavity. Further, the electrostatic actuator 120 performs the flushing operation as an example of a maintenance operation of the head unit 35 in which thickened liquid is ejected by ejecting the liquid droplets from the nozzle 110, and functions even as an example of a maintenance unit.

As illustrated in FIG. 22, the printer 1 has the cap 92 for suction and the sucking pump 94. The cap 92 comes into contact with the head unit 35 and closes a space 263 which the nozzle 110 faces. Hereinafter, the space 263 closed by the cap 92 coming into contact with the head unit 35 is referred to as an airtight space 263. In addition, the sucking pump 94 applies the negative pressure to the airtight space 263, and thereby performs suction cleaning in which the liquid is ejected from the nozzle 110. Also, an air open valve 264, in which the airtight space 263 communicates or does not communicate with air, is provided in the cap 92.

The ink cartridge 31 (the liquid supply source) is an container in which the liquid can be contained and is held to be attachable to and detachable from a mounting section 266. Also, instead of the ink cartridge 31, the liquid supply source may be a containing tank fixed to the mounting section 266. In addition, the containing tank may be a type provided with a pour capable of replenishing liquid. In addition, the mounting section 266 can hold a plurality of ink cartridges 31 or containing tanks in which different types or colors of liquids are contained, respectively.

The supply mechanism 261 has a liquid supply path 262 through which the liquid is supplied from the ink cartridge 31 on the upstream side to the nozzle 110 on the downstream side. Also, the liquid supply path 262 is provided with a supply pump 267 which causes the liquid to flow from the ink cartridge 31 toward the nozzle 110 in a supply direction A, a filter unit 268, and a pressure adjusting valve 269 which adjusts pressure of the liquid. Also, the supply pump 267 can be, for example, a gear pump or a diaphragm pump.

Also, a first filter 271 to a third filter 273 as an example of a function unit are respectively provided in the filter unit 268, the pressure adjusting valve 269, and the head unit 35. Also, the filter 271 to the filter 273 are expendable items which collect a bubble or a foreign substance in the passing liquid and of which a function of passing the liquid is likely to deteriorate as much as the bubbles or foreign substances are collected.

That is, the filter unit 268 has the first filter 271 and is partitioned into an upstream chamber 275 and a downstream chamber 276 by the first filter 271. Also, the filter unit 268 is provided to be attachable to and detachable from the liquid supply path 262. In addition, the pressure adjusting valve 269 has the second filter 272, and the head unit 35 is provided with the third filter 273. Also, the pressure adjusting valve 269 and the head unit 35 are provided to be attachable to and detachable from the liquid supply path 262. That is, the filter 271 to the filter 273 are disposed in the filter unit 268, the pressure adjusting valve 269, and the head unit 35, respectively, to be attachable to and detachable from the liquid supply path 262.

The pressure adjusting valve 269 is provided with a filter chamber 278 and a supply chamber 279 partitioned by the second filter 272. Also, the pressure adjusting valve 269 has a pressure adjusting chamber 281 communicating with the supply chamber 279 through a communication hole 280, a valve body 282 provided between the pressure adjusting chamber 281 and the supply chamber 279, and a bias member 283 which biases the valve body 282 in a valve closing direction. That is, the valve body 282 is inserted into the communication hole 280 and the valve body 282 biased by the bias member 283 is provided to close the communication hole 280.

Further, the pressure adjusting chamber 281 is configured to have a diaphragm 284 in which a part of a wall surface can be bent and deformed along a bias direction of the bias member 283. The diaphragm 284 receives the air pressure on the exterior surface side (left surface side in FIG. 22), and receives pressure of the liquid in the pressure adjusting chamber 281 on the interior surface side (right surface side in FIG. 22). Accordingly, the diaphragm 284 is bent and displaced in accordance with a change in a differential pressure between a pressure inside the pressure adjusting chamber 281 and the pressure received on the exterior surface side, the valve body 282 is displaced in response to the displacement of the diaphragm 284 so as to be opened.

The liquid supply path 262 includes a first connection path 286 to a fourth connection path 289. Specifically, the first connection path 286 connects the ink cartridge 31 and the supply pump 267, and the second connection path 287 connects the supply pump 267 and the upstream chamber 275 of the filter unit 268. The third connection path 288 connects the downstream chamber 276 of the filter unit 268 and the filter chamber 278 of the pressure adjusting valve 269, and the fourth connection path 289 connects the pressure adjusting chamber 281 of the pressure adjusting valve 269 and the reservoir 143 of the head unit 35.

However, the liquid supply path 262 is a path positioned between the ink cartridge 31 and the nozzle 110. That is, the liquid supply path 262 is configured to have the first connection path 286 to the fourth connection path 289, the filter unit 268, the pressure adjusting valve 269, and the head unit 35, and the first filter 271 to the third filter 273 are arranged in the liquid supply path 262.

Also, the control portion 6 (see FIG. 2) according to the embodiment stores a passing amount which indicates an amount of the liquid passing through the filter 271 to the filter 273. That is, the control portion 6 counts how many times the liquid droplets are ejected from the nozzle 110 and how many times the maintenances of the head unit 35 are performed. Also, an amount of the liquid, which is supplied to the nozzle 110 from the ink cartridge 31 and is consumed, is calculated based on the times, and is stored as an amount of passing.

Next, an action in a case in which clogging of the filter 271 to the filter 273 is detected will be described. In the printer 1, when the suction cleaning is performed, liquid is ejected from the nozzle 110 covered by the cap 92 with bubbles or foreign substances. Therefore, when the control portion 6 performs an ejection test process using the ejection abnormality detecting section 10A after the suction cleaning, a concern that the nozzle 110 or the cavity 141 in which bubbles are mixed is detected can be reduced.

Subsequent to the ejection detecting process, when the printer 1 performs the flushing operation of ejecting liquid droplets from the nozzle 110, the liquid is supplied to the nozzle 110 from the ink cartridge 31 through the liquid supply path 262. However, in the liquid supply path 262, the filter 271 to the filter 273 are provided, and liquid is supplied to the nozzle 110 passing through the filter 271 to the filter 273. Therefore, when the filter 271 to the filter 273 is clogged, the flow of the liquid is further inhibited, and thus an amount of liquid possible to be supplied to the nozzle 110 passing through the filter 271 to the filter 273 per unit time becomes less than an amount of liquid that the nozzle 110 is capable of ejecting per unit time.

In other words, in a case in which the filter 271 to the filter 273 are clogged, a sufficient amount of the liquid is not supplied even when the liquid droplets are ejected from the nozzle 110. Then, there is a growing concern that a negative pressure in the liquid supply path 262 between the nozzle 110 and the filters 271 to 273 will be increased and air will be drawn from the nozzle 110. Also, it is possible to detect the nozzle 110 or a cavity in which the bubbles are mixed by performing the ejection test process using the ejection abnormality detecting section 10A. That is, the control portion 6 detects the vibration waveforms of the cavity 141 before and after the flushing operation, and determines whether the filter 271 to the filter 273 are clogged based on a change in the state of the cavity 141 through the flushing operation.

Also, in a case in which the change in the state inside the cavity 141, which is detected before and after the flushing operation, indicates the increase of the bubbles inside the cavity 141, the control portion 6 determines that the filter 271 to the filter 273 are clogged. Specifically, in a case in which the number of cavities 141, in which the bubbles are mixed, detected in the ejection test process after the flushing operation is further increased than that before the flushing operation, it is assumed that the bubbles are mixed according to the flushing operation. That is, the supply mechanism 261 is considered to be in a state in which the filter 271 to the filter 273 are clogged such that it is not possible to supply a sufficient amount of the liquid. Therefore, in a case in which the control portion 6 determines that the filter 271 to the filter 273 are clogged and malfunction, the control portion 6 urges replacement of the filter 271 to the filter 273 through the operation panel 7.

Meanwhile, in a case in which the filter 271 to the filter 273 are determined to normally function, in the same manner as the first embodiment, the control portion 6 is capable of determining whether or not the abnormality of the state inside the cavity 141 is detected by the ejection abnormality detecting section 10A predetermined number of times, and is capable of determining whether or not the abnormality of the ejection state of the ink is detected by the RGB camera 10B predetermined number of times. Also, in a case in which the state inside the cavity 141 is determined to be normal (or the abnormality is detected less than predetermined number of times), and in a case in which the ejection state of the ink is determined to be normal (or the abnormality is detected less than predetermined number of times), the control portion 6 is capable of determining that replacement of the ink jet head 100 is unnecessary. With respect to that, in a case in which it is determined that the abnormality of the state inside the cavity 141 is detected predetermined number of times, and/or in a case in which it is determined that the abnormality of the ejection state of the ink is detected predetermined number of times, the control portion 6 is capable of determining that replacement of the ink jet head 100 is necessary, and causing the operation panel 7 to display the gist so as to notify the gist to the operator.

In the printer 1 according to the embodiment described above, in a case in which the change in the state inside the cavity 141, which is detected before and after the maintenance operation, indicates the increase of the bubbles inside the cavity 141, the control portion 6 is capable of determining that the filter 271 to the filter 273 are clogged. When the filter 271 to the filter 273 of the function unit disposed in the liquid supply path 262 are clogged, the amount of flow which means the amount of the liquid which can pass through the filters per unit time is decreased. Accordingly, when the amount of flow of the liquid which can pass through the filter 271 to the filter 273 becomes less than the amount of liquid ejected from the nozzle 110 per unit time, the air is likely to penetrate from the nozzle 110. In this point, according to this configuration, it is possible to determine the malfunction of the filter 271 to the filter 273 of collecting the foreign substance based on the change in the state inside the cavity 141 before and after the liquid droplet is ejected from the nozzle 110.

Also, the third filter 273 described in the second embodiment can be provided in the head unit 35 of the first embodiment. In this case, the control portion 6 checks that both the third filter 273 and the maintenance unit 72 normally function, and then is capable of determining that replacement of the ink jet head 100 is necessary. Regarding determination whether or not the third filter 273 normally functions, the above-described method can be employed. That is, the control portion 6 is capable of detecting the vibration waveform of the cavity 141 by the ejection abnormality detecting section 10A before and after the flushing operation, and is capable of determining that the filter 273 is clogged based on the change of the state of the cavity 141 through the flushing operation. The control portion 6 is capable of causing the operation panel 7 to display the gist, in a case in which the filter 273 is determined to be clogged.

In addition, in the embodiments described above, it is exemplified that in a case in which at least either of the abnormality of the state inside the cavity 141 or the abnormality of the ejection state of the ink is detected by the detecting section (the ejection abnormality detecting section 10A and the RGB camera 10B) predetermined number of times, the control portion 6 determines that replacement of the ink jet head 100 is necessary; however, a control to be described can be employed.

For example, in a case in which the abnormality of the state inside the cavity 141 is detected predetermined number of times by a first detecting section (ejection abnormality detecting section 10A), and an abnormality of the ejection state of the ink is detected by a second detecting section (the RGB camera 10B) predetermined number of times (in a case in which the state is determined to be normal in a detected result by the second detecting section), it is assumed that the state inside the cavity 141 becomes closer to a non-ejection state when referring to a detection history by the first detecting section in which the ejection is normal. In such a case, a time for the replacement of the ink jet head 100 is determined to be closer, closing of the time for the replacement of the ink jet head 100 can be notified using by the notification unit (the operation panel 7). After that, in a case in which the abnormality of the state inside the cavity 141 is detected by the first detecting section predetermined number of times, and the abnormality of the ejection state of the ink is detected by the second detecting section predetermined number of times, replacement of the ink jet head 100 is determined to be necessary, and thus it is possible to notify the gist again by the notification unit.

In addition, according to the respective embodiments described above, the information management device for remote-monitoring 610 may determine that replacement of the ink jet head 100 is necessary based on the state inside the cavity 141 detected by the ejection abnormality detecting section 10A and the ejection state of the ink detected by the RGB camera 10B. That is, the information management device for remote-monitoring 610 functions as the determination section of the invention. In this case, the control portion 6 may have a function as the determination section, or may not have the function as the determination section.

In addition, according to the respective embodiments described above, the control portion 6 may perform the suction cleaning operation as an example of the maintenance operation of the head unit 35 which causes the cap 92 for suction to come into contact with the head unit 35 and drives the sucking pump 94. Moreover, the state inside the cavity 141 may be detected before the suction cleaning operation and during the suction cleaning operation.

When the negative pressure is applied to the airtight space 263 which the nozzle 110 faces, the pressure inside the nozzle 110 or the cavity 141 communicating with the airtight space 263 becomes the negative pressure. Accordingly, the vibration plate 121 is displaced in a direction in which the capacity of the cavity 141 is decreased. Therefore, when the electrostatic actuator 120 is caused to be driven in a state in which the vibration plate 121 is deformed, and, when the vibration waveform of the cavity 141 which vibrates by the driving of the electrostatic actuator 120 is performed is detected, the vibration waveform is different from the vibration waveform detected in a state in which the vibration plate 121 is not deformed.

Here, the control portion 6 first detects the vibration waveform of the cavity 141 before the suction cleaning operation in a state in which the negative pressure is not applied. Subsequently, the control portion 6 detects the vibration waveform of the cavity 141 during the suction cleaning operation in a state in which the negative pressure is applied. Moreover, the control portion 6 determines that the maintenance unit 72 normally functions in a case in which there is a change inside the cavity 141 between the states before the suction cleaning operation and during the suction cleaning operation.

In this manner, when the negative pressure is applied to the airtight space 263 closed with the cap 92, the negative pressure is also applied to the cavity 141 from the nozzle 110. Moreover, there is a change in the vibration waveforms of the cavity 141 between the case in which the negative pressure is applied to the cavity 141 and the case in which negative pressure is not applied thereto. Accordingly, in the case in which there is a change between the state inside the cavity 141 to which negative pressure is not applied before the suction cleaning operation, and the state inside the cavity 141 to which the negative pressure is applied during the suction cleaning operation, it is determined that the negative pressure is applied to the cavity 141 and the maintenance unit 72 normally functions.

In addition, in the same manner, the control portion 6 causes the sucking pump 94 to be driven by causing the cap 92 for suction to come into contact with the head unit 35, and detects the state inside the cavity 141 in a state in which the air open valve 264 (see FIG. 22) communicates with the airtight space 263 and the air (in a state in which a negative pressure is not applied) and a state in which the air open valve does not communicate with the airtight space and the air (in a state in which the negative pressure is applied), so that the air open valve 264 may be determined to normally function.

In addition, in the case in which the vibration waveform of the cavity 141 is detected during the suction cleaning operation in the same manner, a valve may be provided on the upstream side of the cavity 141 and the suction cleaning operation may be performed in a state in which the valve is closed. That is, when the valve is provided, which enables the liquid to be less consumed and the vibration plate 121 to be easily deformed.

In addition, according to the respective embodiments described above, the control portion 6 may perform driving of the electrostatic actuator 120 for determining whether or not the abnormality of the state inside the cavity 141 is detected by the ejection abnormality detecting section 10A predetermined number of times (pressure chamber abnormality determining process: S3) at a position where the ink jet head 100 corresponds to the liquid receiving portion 73, or may perform the driving at a position where the ink jet head corresponds to the recording area PA. In addition, according to the respective embodiments described above, the control portion 6 may not perform the maintenance unit normality determining process S1.

In addition, according to the respective embodiments described above, in a case in which it is determined that the state inside the cavity 141 is normal in the pressure chamber abnormality determining process S3 but the paper dust attached to near the outlet of the nozzle 110, the control portion 6 may cause wiping with the wiping unit 81. In addition, in this case, the maintenance operation may be selected depending on the number of the nozzles of which the paper dust is determined to be attached to near the outlet of the nozzle 110. For example, in a case in which the number of the nozzles of which the paper dust is determined to be attached to near the outlet of the nozzle 110 is less than the number of set nozzles, the wiping unit 81 performs wiping, and in a case in which the number of the nozzles of which the paper dust is determined to be attached to near the outlet of the nozzle 110 is equal to or more than the number of set nozzles, the suction cleaning may be performed.

In addition, according to the each embodiments described above, the maintenance unit 72 may be disposed in the non-recording area NA on the 80-digit side, or elements of the maintenance unit 72 may be disposed in the non-recording areas NA on both sides of the recording area PA. For example, while the cleaning mechanism 91 that has the cap for suction that can enclose all the nozzles 110 at the same time in the non-recording area NA on the 1-digit side is disposed, the flushing unit 74 may be disposed in the non-recording area NA on the 80-digit side. According to this configuration, it is possible to perform the detection of the abnormal ejection followed by the ejection of the liquid droplets in any one of the non-recording areas NA.

In addition, according to the embodiment described above, the wiping member 82 is not limited to a belt-shaped member that can absorb liquid. For example, a blade-shaped wiping member (wiping member) is formed with elastomer or the like that does not absorb liquid, and a distal end portion of the wiping member that can be elastically deformed may be the wiping portion. However, if the wiping member is the member that can absorb liquid, it is preferable since the liquid is not scattered by the wiping to the surroundings.

In addition, according to the respective embodiments described above, the ejection abnormality detecting section 10A as the first detecting section and the method for detecting the abnormal ejection of the nozzles and the cause of the abnormal ejection are not limited to the method of detecting and analyzing the vibration patterns of the residual vibration in the vibration plate described above. Modification examples of the method of detecting the abnormal ejection are as follows. For example, there is a method of causing an optical sensor such as a laser sensor to perform irradiation and reflection directly on meniscuses of the ink in the nozzles, detecting a vibration state of the meniscuses by a light receiving element, and specifying the cause of the clogging from the vibration state.

Otherwise, whether the abnormal ejection exists or not is detected by using a general optical dot omission detecting apparatus that detects whether flying liquid droplets are included in the detection scope of the sensor. Also, there is a method of assuming that the abnormal ejection occurring after a predetermined drying time in which dot omission possibly occurs has passed since the ejection operation is caused by the drying, and assuming that the abnormal ejection occurring before the drying is caused by the attachment of foreign substances or the bubble mixture.

In addition, there is a method of adding a vibration sensor to the optical dot omission detecting apparatus, determining whether the vibrations that can cause bubbles to be mixed are added before the abnormal ejection occurs, and assuming that the cause of the abnormal ejection is the bubble mixture if such vibrations are added.

Moreover, the dot omission detecting section does not have to be limited to an optical type, and a heat sensing-type detecting apparatus that detects a temperature change of a heat sensing portion by receiving the ejection of the liquid drops, a detection apparatus that detects the change of the charge amount of detection electrodes that eject and impact ink drops by charging the ink drops, or an apparatus of detecting electrostatic capacity that changes by the passage of the ink drops between electrodes may be used. In addition, as a method of detecting the attachment of paper dust, a method of detecting a state of a nozzle surface by a camera or the like as image information, and a method of detecting whether paper dust attachment exists or not by scanning a portion near a nozzle surface with an optical sensor such as a laser sensor are considered.

In addition, according to the respective embodiments described above, the liquid droplet ejecting apparatus may be changed to a so-called full line-type liquid droplet ejecting apparatus that does not include the carriage 32, but includes a long and fixed liquid droplet ejecting unit corresponding to the entire width (length in main scanning direction) of the recording medium. The liquid droplet ejecting unit in this case may have a printing scope to range the entire width of the recording sheet P by performing the parallel arrangement of a plurality of unit heads in which the nozzles are formed, or may have a printing scope to range the entire width of the recording sheet P by arranging multiple nozzles in a single long head so as to range the entire width of the recording sheet P. In this case also, since the printing for one line by the liquid droplet ejecting unit and the intermittent transportation of the recording medium are alternately performed, it is possible to perform the maintenance operation such as the wiping, for example, while the recording medium is transported.

In addition, according to the respective embodiments described above, a piezoelectric element may be provided as an actuator which causes the cavity 141 as an example of the pressure chamber of the head unit 35 to vibrate. Also, the control portion 6 may detect the vibration waveform of the cavity 141 which vibrates by the driving of the piezoelectric element and thereby may detect the state of the cavity 141.

In addition, according to the respective embodiments described above, a sensor for detecting the vibration waveform of the cavity 141 may be provided separately from the actuator for ejecting ink drops from the nozzle 110. Also, the control portion 6 may detect the state of the cavity 141 by detecting the vibration waveform of the cavity 141 which is vibrated by the sensor. In this case, a piezoelectric element may be employed as a sensor.

In addition, according to the respective embodiments described above, the notification unit may be a device which emits a sound or light to urge the replacement and may be provided separately from the printer 1. For example, the host computer 8 may be used as the notification unit and may display a message or an image to urge the replacement. In addition, the notification unit may not be provided.

The invention is not limited to the embodiments described above, and modifications of the embodiment that those skilled in the art appropriately design are also included in the scope of the invention as long as features are included. That is, elements and arrangement, materials, conditions, shapes, sizes, and the like provided in each embodiment are not limited to the examples, and can be appropriately modified. In addition, the elements included in each embodiment can be combined technically as much as possible, and combinations thereof are included in the scope of the invention as long as the features are included in the invention.

The entire disclosure of Japanese Patent Application No. 2017-040117, filed Mar. 3, 2017 is expressly incorporated by reference herein.

What is claimed is:

1. A liquid droplet ejecting apparatus comprising:

a liquid droplet ejecting head that includes a plurality of nozzles from which a liquid supplied from a liquid supply source through a liquid supply path is ejected as a liquid droplet, and ejects the liquid droplet from the nozzle to a recording medium to perform a recording process;

a first detecting section configured to detect a state inside a pressure chamber by measuring a vibration waveform of the pressure chamber, which is vibrated by driving an actuator capable of vibrating the pressure chamber communicating with the nozzle;

a second detecting section configured to detect an ejection state of the liquid droplet by reading a pattern formed on the recording medium by the liquid droplet ejecting head ejecting the liquid droplet from the nozzle; and a determination section that determines a replacement necessity of the liquid droplet ejecting head based on a detected result of the first detecting section and a detected result of the second detecting section, wherein the determination section determines that replacement of the liquid droplet ejecting head is necessary in a case in which abnormality of the state inside the pressure chamber is detected by the first detecting section and abnormality of the ejection state is detected by the second detecting section, and the determination section determines that replacement timing of the liquid droplet ejecting head is close in a case in which abnormality of the state inside the pressure chamber is detected by the first detecting section and normality of the ejection state is detected by the second detecting section.

2. The liquid droplet ejecting apparatus according to claim 1, further comprising:

a maintenance unit that performs maintenance of the liquid droplet ejecting head, wherein the determination section determines that replacement of the liquid droplet ejecting head is necessary in a case in which measurement of the vibration waveform by the first detecting section and reading of the pattern by the second detecting section are performed after the maintenance is performed by the maintenance unit, and the abnormality of the state inside the pressure chamber is detected by the first detecting section for a predetermined number of times and the abnormality of the ejection state is detected by the second detecting section for a predetermined number of times.

3. The liquid droplet ejecting apparatus according to claim 2, wherein the determination section is configured to check that a function unit disposed in the liquid supply path and the maintenance unit function normally by the first detecting section detecting the vibration waveform of the pressure chamber before the maintenance operation and detecting the vibration waveform of the pressure chamber at a time of at least one of during the maintenance operation and after the maintenance operation, wherein the determination section determines that replacement of the liquid droplet ejecting head is necessary after checking the function unit and the maintenance unit function normally.

4. The liquid droplet ejecting apparatus according to claim 3, wherein the determination section determines that at least one of the function unit and the maintenance unit malfunctions in a case in which bubbles inside the pressure chamber are determined to be increased through the maintenance operation based on the vibration waveform detected by the first detecting section.

5. The liquid droplet ejecting apparatus according to claim 4, wherein the maintenance unit includes a moisturizing cap, which includes a cap section that comes into contact with the liquid droplet ejecting head and closes a space which the nozzle faces and an air communicating section through which the space communicates with air, and causes the cap section to close the space as the maintenance operation, wherein the first detecting section detects the vibration waveform of the pressure chamber before the cap section closes the space, and detects the vibration waveform of the pressure chamber after the cap section which closes the space opens the space, and wherein the determination section determines that the air communicating section malfunctions in a case in which a change of the state inside the pressure chamber means an increase of bubbles inside the pressure chamber.

6. The liquid droplet ejecting apparatus according to claim 4, wherein the function unit includes a filter which is disposed in the liquid supply path and collects a foreign substance, wherein the maintenance unit causes the liquid to be ejected from the nozzle as the maintenance operation, and wherein the determination section determines that the filter is clogged in a case in which a change between states inside the pressure chamber, which are detected before and after the maintenance operation, means the increase of bubbles inside the pressure chamber.

7. The liquid droplet ejecting apparatus according to claim 1, further comprising:

a notification unit that, in a case in which the determination section determines that replacement of the liquid droplet ejecting head is necessary, notifies an operator accordingly.

8. The liquid droplet ejecting apparatus according to claim 1, further comprising:

a communicating section that is communicably connected to an external device, wherein information relating to the state inside the pressure chamber detected by the first detecting section and information relating to the ejection state of the liquid droplet detected by the second detecting section are transmitted to the external device which is communicably connected through the communicating section.

9. A remote monitoring system comprising:

the liquid droplet ejecting apparatus according to claim 8; and an information management device for remote-monitoring that collects and manages via the communicating section the information relating to the state inside the pressure chamber detected by the first detecting section and the information relating to the ejection state of the liquid droplet detected by the second detecting section.

10. The remote monitoring system according to claim 9, further comprising:

a maintenance service request information generating section that generates information for requesting a call for a service man with respect to the liquid droplet ejecting apparatus in which replacement of the liquid droplet ejecting head is determined to be necessary based on the state inside the pressure chamber detected by the first detecting section and the ejection state of the liquid droplet detected by the second detecting section.

11. A method of determining a replacement necessity of a liquid droplet ejecting head of a liquid droplet ejecting apparatus which includes a liquid droplet ejecting head that includes a plurality of nozzles from which liquid supplied from a liquid supply source through a liquid supply path is ejected as a liquid droplet, and ejects the liquid droplet from the nozzle to a recording medium to perform a recording process, a maintenance unit that performs maintenance of the liquid droplet ejecting head, a first detecting section that detects a state inside a pressure chamber by measuring a vibration waveform of the pressure chamber, which is vibrated by driving an actuator capable of vibrating the pressure chamber communicating with the nozzle; and a second detecting section that detects an ejection state of the liquid droplet by reading a pattern formed on the recording medium by the liquid droplet ejecting head ejecting the liquid droplet from the nozzle, the method comprising:

determining that replacement of the liquid droplet ejecting head is necessary in a case in which abnormality of the state inside the pressure chamber is detected by the first detecting section and abnormality of the ejection state is detected by the second detecting section, and determining that replacement timing of the liquid droplet ejecting head is close in a case in which abnormality of the state inside the pressure chamber is detected by the first detecting section and normality of the ejection state is detected by the second detecting section.

12. The method of determining a replacement necessity of a liquid droplet ejecting head according to claim 11, further comprising:

checking that the function unit disposed in the liquid supply path and the maintenance unit function normally by the first detecting section detecting the vibration waveform of the pressure chamber before the maintenance operation and detecting the vibration waveform of the pressure chamber at a time of at least one of during the maintenance operation and after the maintenance operation, and determining the replacement necessity of the liquid droplet ejecting head.

* * * * *